US012788128B2

(12) United States Patent
Porche, Jr.

(10) Patent No.: US 12,788,128 B2
(45) Date of Patent: Nov. 10, 2026

(54) UNIVERSAL PANEL LIFT AND CARRY APPARATUS

(71) Applicant: Joseph Merrial Porche, Jr., Metairie, LA (US)

(72) Inventor: Joseph Merrial Porche, Jr., Metairie, LA (US)

( * ) Notice: Subject to any disclaimer, the term of this patent is extended or adjusted under 35 U.S.C. 154(b) by 644 days.

(21) Appl. No.: 18/237,700

(22) Filed: Aug. 24, 2023

(65) Prior Publication Data

US 2024/0349877 A1 Oct. 24, 2024

Related U.S. Application Data

(60) Provisional application No. 63/401,405, filed on Aug. 26, 2022.

(51) Int. Cl.
*A45F 3/14* (2006.01)

(52) U.S. Cl.
CPC ..... *A45F 3/14* (2013.01); *A45F 2003/142* (2013.01)

(58) Field of Classification Search
CPC .. A01K 27/001; A01K 27/003; A01K 27/004; A01M 31/006; A41F 9/005; A45C 13/30; A45C 13/38; A45C 2013/303; A45C 2013/306; A45F 3/14; A45F 5/021; A45F 5/10; A45F 5/102; A45F 5/1026; A45F 2003/142; A45F 2003/144; A45F 2003/146; A45F 2003/148; A45F 2005/1006; A45F 2005/1013; A45F 2005/1033; A45F 2005/1053; A45F 2005/106; A63B 21/0552; A63B 21/0557; A63B 21/4019; A63B 21/4021; B65G 7/12
USPC ..... 294/26
See application file for complete search history.

(56) References Cited

U.S. PATENT DOCUMENTS

| | | | |
|---|---|---|---|
| 2,399,786 | A | 5/1946 | Caton |
| 2,428,941 | A | 10/1947 | Packard |
| 4,098,442 | A | 7/1978 | Moore |
| 4,113,160 | A | 9/1978 | Spiers |
| 4,190,278 | A | 2/1980 | Jancik, Jr. |
| 4,235,355 | A | 11/1980 | Henry et al. |
| D317,703 | S | 6/1991 | Cydrus |
| 5,069,495 | A | 12/1991 | Mears |
| D349,437 | S | 8/1994 | Mock et al. |
| D351,769 | S | 10/1994 | Brass et al. |

(Continued)

FOREIGN PATENT DOCUMENTS

KR 2025087165 A * 6/2025

OTHER PUBLICATIONS

U.S. Appl. No. 13/231,286, filed Aug. 28, 2012, Homan.

(Continued)

*Primary Examiner* — Joshua E Rodden
(74) *Attorney, Agent, or Firm* — Garvey, Smith & Nehrbass, Patent Attorneys, L.L.C.; Fabian N. Nehrbass; Seth M. Nehrbass

(57) ABSTRACT

The Universal Panel Lift and Carry Apparatus discloses a simple tool design for securing, lifting, and transporting various objects. The apparatus combines the advantages of a hook or grabbing hardware with carrying multiple options, ensuring safer and more effective object handling. This Universal Panel Lift and Carry Apparatus represents an innovative and practical solution for homeowners and professionals requiring a comprehensive lifting and carrying tool.

21 Claims, 25 Drawing Sheets

(56) References Cited

U.S. PATENT DOCUMENTS

| | | | | |
|---|---|---|---|---|
| 5,363,810 | A * | 11/1994 | Kraus | A01K 27/003 119/795 |
| 5,397,158 | A | 3/1995 | Brass | |
| D412,270 | S | 7/1999 | Fredrickson | |
| D423,309 | S | 4/2000 | Sirmans | |
| 6,250,699 | B1 * | 6/2001 | Robertson | A01M 31/006 294/152 |
| D462,497 | S | 9/2002 | Talamantes | |
| 6,857,673 | B2 | 2/2005 | Lang | |
| D642,026 | S | 7/2011 | Martin | |
| 8,251,421 | B1 * | 8/2012 | Homan | A45F 5/10 294/142 |
| 9,936,678 | B2 * | 4/2018 | Sebö | A01K 15/02 |
| 10,131,499 | B1 | 11/2018 | Porche, Jr. | |
| 2002/0023595 | A1 * | 2/2002 | Kaufman | A01K 27/003 119/797 |
| 2007/0205235 | A1 * | 9/2007 | Knight | B25H 3/00 224/681 |
| 2009/0308329 | A1 * | 12/2009 | Sanchez | A01K 27/003 119/795 |
| 2010/0187274 | A1 | 7/2010 | Chock, Jr. | |
| 2010/0288207 | A1 * | 11/2010 | Hollenbeck | A01K 27/003 119/797 |
| 2011/0094011 | A1 * | 4/2011 | Klekamp | A63B 21/4021 2/170 |
| 2011/0259929 | A1 * | 10/2011 | Edlebeck | A45F 3/14 224/264 |
| 2012/0145756 | A1 * | 6/2012 | Fuller | A45F 3/14 224/257 |
| 2013/0167782 | A1 * | 7/2013 | Poch | A01K 27/003 119/795 |
| 2015/0033510 | A1 * | 2/2015 | Nagi | A45F 3/14 24/302 |
| 2015/0250144 | A1 * | 9/2015 | Lin | A01K 27/003 119/792 |
| 2016/0050887 | A1 * | 2/2016 | Polcyn | A01K 27/003 119/797 |
| 2016/0050905 | A1 * | 2/2016 | Owen | A01M 31/006 224/103 |
| 2016/0309699 | A1 * | 10/2016 | O'Donnell | F41C 33/001 |
| 2017/0064928 | A1 * | 3/2017 | Seuk | A01K 27/001 |
| 2018/0272177 | A1 * | 9/2018 | Negron | A63B 21/068 |
| 2018/0359997 | A1 * | 12/2018 | Hogg | A01K 27/003 |
| 2019/0014888 | A1 * | 1/2019 | Duncan | A45C 13/30 |
| 2022/0117200 | A1 * | 4/2022 | Fronapfel | A01K 27/009 |
| 2023/0210090 | A1 * | 7/2023 | Riffeser | A01K 27/005 119/794 |
| 2024/0268350 | A1 * | 8/2024 | Zhu | A01K 27/003 |
| 2026/0069023 | A1 * | 3/2026 | Katz | A45F 3/14 |

OTHER PUBLICATIONS

Gator Lift—Panel Carrier Clamp-top, https://www.gatorlift.com, Dec. 1, 2025.

Gorilla Gripper—Contractor Grade Clamp-top, https://www.arrowtoolgroup.com/gorilla-gripper-panel-carrier, Dec. 1, 2025.

MetalTech BuildMan JawClaw Clamp-top, https://www.homedepot.com/p/MetalTech-BuildMan-Grade-JawClaw-Panel-Gripper-Aluminum-Multipurpose-Panel-Clamp-I-IJC/311913669, Dec. 1, 2025.

FivePears Professional Panel Carrier Clamp-top, https://www.amazon.com/dp/B0BXC5FJLS, Dec. 1, 2025.

Trademark Innovations Plywood Lifting Tool Clamp-top, https://www.walmart.com/ip/Plywood-Lifting-Tool-Sheetrock-Lifter-Drywall-Panel-Lifter-Lifting-Tool/8249752184, Dec. 1, 2025.

Angel Sar Drywall Panel Hoist Clamp-top, https://www.homedepot.com/p/Angel-Sar-Black-Drywall-Panel-Hoist- EU22PG96/334744223, Dec. 1, 2025.

KFFKFF Plywood Carrier Clamp-top, https://www.walmart.com/ip/KFFKFF-Plywood-Carrier-200-lbs-Load-Capacity/17006066806, Dec. 1, 2025.

Generic Plywood Lifting Tool (Amazon) Clamp-top, https://www.amazon.com/dp/B0F6MSPM8F, Dec. 1, 2025.

Panel Gripper Carrier (ABS) Clamp-top, https://www.walmart.com/ip/Panel-Gripper-Carrier-ABS/884544765, Dec. 1, 2025.

Carry Handle Gripper (eBay) Clamp-top, https://www.ebay.com/itm/256311562367, Dec. 1, 2025.

AUTSUPPL Multi-Use Panel Carrier Clamp-top, https://www.amazon.com/dp/BODFMWGXF1, Dec. 1, 2025.

IWOWHERO Drywall Carrier Clamp-top, https://www.amazon.com/dp/BODQGWK7LB, Dec. 1, 2025.

Stanley Panel Carry 93-300K Under-edge, https://www.homedepot.com/p/Stanley-Panel-Carry-93-300K/202262083, Dec. 1, 2025.

ODYN Drywall Panel Carrier Under-edge, https://www.bedrosians.com/en/product/detail/supplies-tool/? itemNo=ODYCARPANDRY, Dec 1, 2025.

MARSHALLTOWN Lift Lender Under-edge, https://www.homedepot.com/p/MARSHALLTOWN-Lift-Lender-Carry-All-LLNDR/327330048, Dec. 1, 2025.

Wal-Board Lift Lender Under-edge, https://www.lowes.com/pd/WAL-BOARD-TOOLS-40-lbs-Load-Capacity-Plastic-drywall-panel-carrier/5015279801, Dec. 1, 2025.

Powertec 72086 Panel Carrier Under-edge, https://powertecproducts.com/72086-p2-panel-carrier-2pk-for-plywood-drywall, Dec. 1, 2025.

Skelang Drywall Carrier Under-edge, https://www.amazon.com/Best-Sellers-Panel-Carriers/zgbs/industrial/256385011, Dec. 1, 2025.

Threlaco Plywood Carrier Under-edge, https://www.amazon.com/Best-Sellers-Panel-Carriers/zgbs/ industrial/256385011, Dec. 1, 2025.

* cited by examiner

UNIVERSAL PANEL LIFT AND CARRY APPARATUS

CROSS-REFERENCE TO RELATED APPLICATIONS

My earlier filed provisional patent application No. 63/401,405, filed 26 Aug. 2022, is hereby incorporated in this application for reference and priority from, and benefit of, said application is hereby claimed.

BACKGROUND OF THE INVENTION

Field of the Invention

The innovation relates to a Universal Panel Lift and Carry Apparatus, a versatile and efficient tool designed to secure lifting and transport various objects. The apparatus features a single-layer flat flexible webbing made from durable polyester webbing, incorporating a rubber-coated metal hook hardware and a movable non-fixed handle and carabiner for ergonomic lifting and carrying options. Its unique design includes multiple daisy chain loop segments sewn onto the flat flexible webbing, allowing adaptable configurations and adjustable attachment points, and flexible webbing length for versatile connections in diverse lifting scenarios.

General Background

Moving heavy objects, such as door frames, metal panels, drywall, paneling, and plywood, poses significant challenges and risks as one of the obstacles to holding them with a firm grip. The task requires physical strength, balance, and coordination, particularly in fast-paced construction environments. Improper lifting techniques can lead to costly spine and joint injuries, financial burdens, rehabilitation, surgery, and functional disability. The current solutions on the market need several crucial aspects, making them inferior and inadequate for addressing these challenges.

Existing products are often large, bulky, and need more portability. They cannot be easily stored away for reuse or transported between tasks, hindering efficiency and convenience. Additionally, their attachment and release mechanisms could be more convenient, causing unnecessary delays and interruptions in workflow.

Furthermore, these inferior solutions typically have fixed lengths, rendering them less adaptable to different user needs. This limitation excludes short or tall individuals from achieving optimal comfort and performance. Non-ergonomic handles exacerbate the problem by failing to distribute stress evenly on the hands, mainly when working on inclines. The lack of a reduced slip surface increases the risk of accidents and injuries.

Another improvement for existing products is their single-use nature, providing limited functionality and versatility. They lack interchangeable hook attachments, preventing customization according to specific size and shape requirements. This lack of adaptability and options makes them less desirable and ineffective in various scenarios.

The Universal Panel Lifting and Carrying Apparatus overcomes these deficiencies and provides a superior solution for safe and efficient lifting and carrying tasks. Its innovative design addresses the limitations of existing products by offering portability, quick attachment and release, adjustable length, ergonomic handles, reduced slip surface, and interchangeable hook attachments. This comprehensive set of features elevates the apparatus above inferior solutions and ensures enhanced productivity, reduced fatigue, and minimized risks of costly injuries.

SUMMARY OF INVENTION

This innovation relates to the lifting and carrying of heavy goods, a dire need in our daily lives. The following description highlights its uniqueness and uniqueness.

The universal panel lift and carry apparatus mitigates joint and spine injuries by providing two ergonomic methods for moving and holding goods. One way of lifting and moving an item is through an innovative handle, and the second method of lifting and moving an object is the padded loop wrist wrap. The handle and the padded wrist loop offer a more comfortable and safer lifting of heavier and awkward weights than without the universal panel lift and carrying apparatus, thereby reducing the risk of injury and improving work production. Additionally, the design incorporates a long lever arm of flat flexible webbing with daisy chain loop segments sewn onto multiple locations of the flat flexible webbing. The non-fixed handle can be connected to the daisy chain loop of choice to improve lifting in a more upright position, therefore improving pulling power while minimizing spinal flexion, twisting, and joint overextension during the lifting process. By optimizing the lifting position by hand or padded wrist loop, this universal panel lifting and carry apparatus significantly enhances safety by also protecting the hand from hot, sharp, and rough surfaces.

By using the universal panel lift and carry apparatus, individuals can safely increase the weight or load they lift and carry while minimizing fatigue during repetitive lifting tasks. The wrist loop opening serves multiple functions: a) it frees up the hand for other uses, such as improving balance; b) it distributes the weight of the item to the wrist, reducing hand stress and enabling improved safety when lifting heavier loads; c) it allows the universal panel lift and carry apparatus to remain attached to the user, enhancing efficiency without the need for frequent storage or retrieval; d) it serves as a security or safety strap, for example; if your hand loses grip, the wrist loop worn correctly will allow the person to maintain control of the item to reduce damage to the item and reduce possible injury to the person carrying the item.

The apparatus incorporates hook hardware, including but not limited to rubber-coated dual-leg J-hook hardware, chosen for quick and secure attachment and release of panels or similar items. This hook hardware rubber coating minimizes slip or sliding during lifting, ensuring improved stability and slip resistance while moving items up or down inclines.

A vital feature of the invention is a patented non-fixed, adjustable handle with a removable locking peg and a heavy-weight capacity aluminum carabiner. These essential components allow for easy adjustment of the webbing length and configuration by attachment of the handle and carabiner at the multiple daisy chain loop segments located at numerous locations on the flat flexible webbing. The carabiner provides convenient storage of the universal panel lift and carrying apparatus on a tool belt or other designated facility storage areas when the apparatus is not in use.

This invention combines the unique elements of a handle, carabiner, daisy loop webbing, and padded wrist loop to create a panel lifting system. It surpasses existing technologies by integrating a patented non-fixed removable handle and a padded loop wrist strap, enabling safe and efficient lifting and moving of panels. The reduced slip rubber-coated hook hardware improves usability and safety, particularly when navigating inclines. The lightweight, portable nature of the apparatus allows for easy transport and convenient storage on a belt loop or tool belt. This tool offers a simple, effective solution for various lifting and carrying needs.

One of the basic versions of the invention is the "Panel Lift and Carry Apparatus," which comprises the following vital aspects and core components:

Flexible Webbing Assembly: The apparatus features a single-layer flat flexible webbing made from polyester. The webbing serves as the primary structure for the invention, providing strength and flexibility.

Fixed Loop Ends: The flexible webbing includes fixed loop ends. One end attaches to hook hardware or grabbing apparatus, while the opposite loop end is a padded loop wrist strap created to secure the apparatus at the wrist or used as a grabbing point.

Daisy Chain Loops: Daisy chain loop segments are on multiple locations of the flexible webbing. These loops provide multiple attachment points, enhancing versatility with many configurations and adaptability.

Hook Hardware: The apparatus incorporates interchangeable rubber-coated metal hook hardware for improved grip, reduces slippage, and provides item protection. The hook hardware shape securely grabs or hooks an object, recreating the action of a hand holding an item.

Handle: The apparatus includes a non-fixed handle(s) with a locking removable peg that may connect with the flat flexible webbing at various daisy chain loop segments. The handle provides a comfortable grip and allows for easier lifting and carrying of objects. The handle is made from HDPE or other possible materials and can be connected to the daisy chain loop segment directly or indirectly.

Carabiner: A carabiner is part of the apparatus to store the device for easy and fast retrieval. The carabiner has a spring hook mechanism for quick and reversible attachment to the daisy chain loop segments. It also allows for easy adjustment of the length and configuration of the flexible flat webbing, enabling efficient customization for moving different objects and lifting scenarios.

The mechanical functionality comprising of flexible webbing assembly forms the foundation of the apparatus, providing the structure and flexibility needed for lifting and carrying objects. The first fixed smaller loop end allows for secure hook hardware or grabbing apparatus attachment on one end. In contrast, the second larger fixed loop is padded for a wrist wrap end, providing a secure and comfortable wrist attachment.

The daisy chain loop segments on the flexible webbing offer multiple attachment points for adjusting the length and configuration of the apparatus and for attaching the handle and carabiner. The daisy chain loop segments allow for versatility in lifting different objects and adapting to various lifting scenarios.

The hook hardware, coated with rubber, enables secure grabbing or hooking of items, reducing the slip or sliding of things during lifting. When attached to the daisy chain loops, the handle provides a comfortable grip for improved control when lifting and carrying. The carabiner facilitates easy and quick adjustment or storage of the apparatus, allowing users to customize the length and configuration of the flat flexible webbing to suit the user's needs.

By utilizing flexible webbing, fixed loop ends, daisy chain loops, hook hardware, handle, and carabiner, the Universal Panel Lift and Carry Apparatus provides a comprehensive solution for secure lifting and carrying objects.

The Universal Panel Lifting and Carrying Apparatus may include several optional features to enhance its functionality and versatility further. These optional features add to the essential components mentioned above. Some of the below optional features may use:

Adjustable Length: The flexible webbing can have an adjustable length mechanism, such as a buckle or sliding mechanism, allowing users to easily customize the length of the webbing to suit different lifting and carrying needs.

Material Options: Besides the mentioned materials (cotton, nylon, Dyneema, polyester, and polypropylene), the flexible webbing types include materials that provide specific advantages such as increased strength, durability, or resistance to environmental factors.

Additional Daisy Chain Loops: Larger quantities and longer segments of daisy chain webbing loops can be sewn at various positions along the length of the flexible webbing, increasing the number of attachment points and further enhancing adjustability and versatility.

Multiple Hardware Apparatus: The apparatus can include interchangeable hardware apparatus, such as hooks with single or multiple protrusions and variable widths between protrusions, J-hooks, L-hooks, or U-hooks, attached to the first smaller fixed loop ends of the flat flexible webbing. These hooks can have various sizes and shapes, providing flexibility for lifting scenarios and object types.

Ergonomic Handles: Other ergonomic handle designs can be incorporated. These handles can feature improved grip, padding, manufactured material, or contouring for enhanced strength and comfort during lifting and carrying tasks. In addition, methods of connecting a handle to the apparatus include but are not limited to, attaching a handle by peg, hook, clip, carabiner, rope, or webbing.

Varied Carabiners: The non-fixed, reversible connected carabiners can come in various sizes, shapes, or quantities. Specific use allows the final product to include the most suitable carabiner(s) based on user needs, such as weight capacity, durability, product weight, size, or ease of use.

Unlike other solutions, the apparatus gives the adjustability for Best Ergonomics, allowing users to easily adjust the length of the pull distance by attaching handles and carabiners at different locations along the daisy chain loops. This adjustability ensures that individuals of varying heights, whether short, tall, or average, can achieve optimal ergonomics, reducing strain and improving control and work production when repetitively lifting and carrying.

The apparatus design is to be lightweight and portable, making it convenient to carry and transport. Its compact size and easy storage on a tool belt loop or hangs from the wrist allow users to have the panel lift and carry apparatus readily available without hindering mobility or adding unnecessary bulk.

The apparatus has a relatively low cost for manufacturing. The materials used in manufacturing are polyester webbing and standard hardware components, which are readily available and affordable. This cost-effectiveness contributes to the accessibility and widespread adoption of the tool.

Another distinguishing aspect of the apparatus is its incorporation of replaceable parts. The interchangeable size and style of hook apparatus provide versatility, allowing users to select the most suitable hook hardware for different objects or scenarios. This feature enhances the functionality and adaptability of the apparatus, making it valuable for various lifting and carrying applications.

This disclosure provides a more detailed and specific description of the accompanying drawings. The drawings and detailed descriptions of the illustrations, and any specific or alternative embodiments discussed, are intended to be read in conjunction with the entirety of this disclosure.

The Universal Panel Lift and Carry Apparatus may, however, be embodied in many different forms and may not limit the set forth embodiments herein; instead, these embodiments are provided by way of illustration only so this disclosure may understand easily.

BRIEF DESCRIPTION OF THE DRAWINGS

For a better understanding of the nature, objects, and advantages of the present invention, the "Universal Panel Lift and Carry Apparatus" reference may be read in conjunction with the following drawing figures.

DETAILED DESCRIPTION OF THE INVENTION

Figure 1:
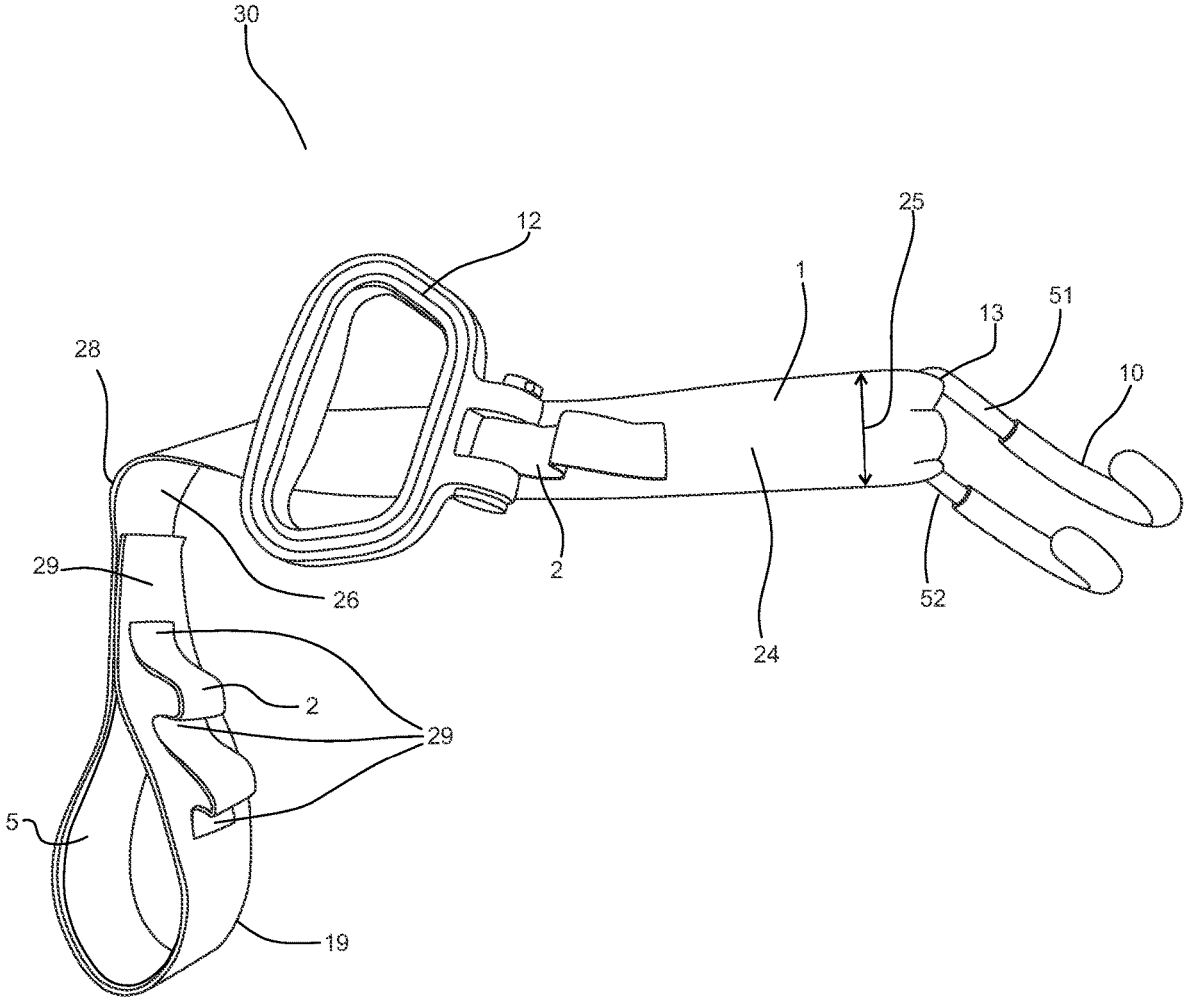
FIG. 1.—is a diagram illustrating a top view of a panel lift apparatus in accordance with an exemplary embodiment.

FIGS. 1-25 show a preferred embodiment of the apparatus of the present invention, designated generally by the numeral 30 in FIG. 1. The Apparatus 30 of the present invention includes a flat flexible webbing 1, hook hardware 13, carabiner 11, handle 12, and padded wrist loop 19 arrangement of an improved configuration wherein a user attaches a selected item or panel by way of connecting the hook hardware 13 and pulling upward or outward by the handle 12 or padded wrist loop 19 to lift and carry.

The following description provides a detailed step-by-step explanation of the invention's structure, functionality, and interconnections:

FIG. 1.—is a diagram illustrating a top view of a universal panel lift apparatus 30 in accordance with an exemplary embodiment. This apparatus design facilitates the lifting and handling panels or similar awkward and heavy objects. The apparatus comprises a flexible webbing 1 with fixed loop openings 3 and 19.

Figure 2A:
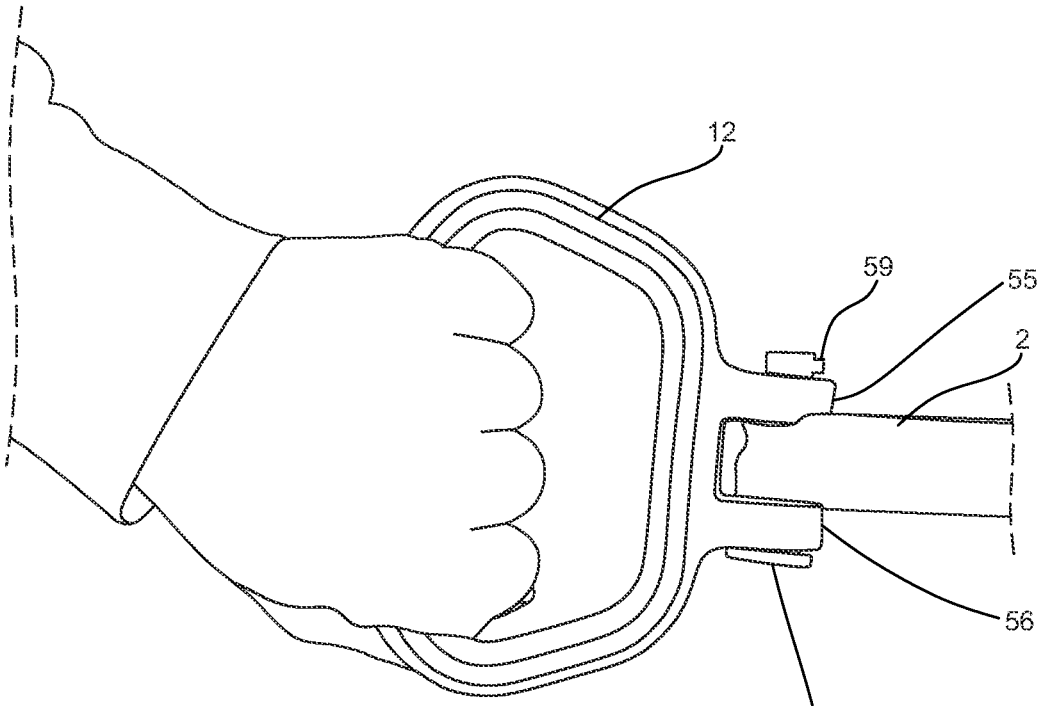
FIG. 2A.—is a diagram illustrating a top view of an exemplary panel lift apparatus handle at the first use stage.
Figure 2B:
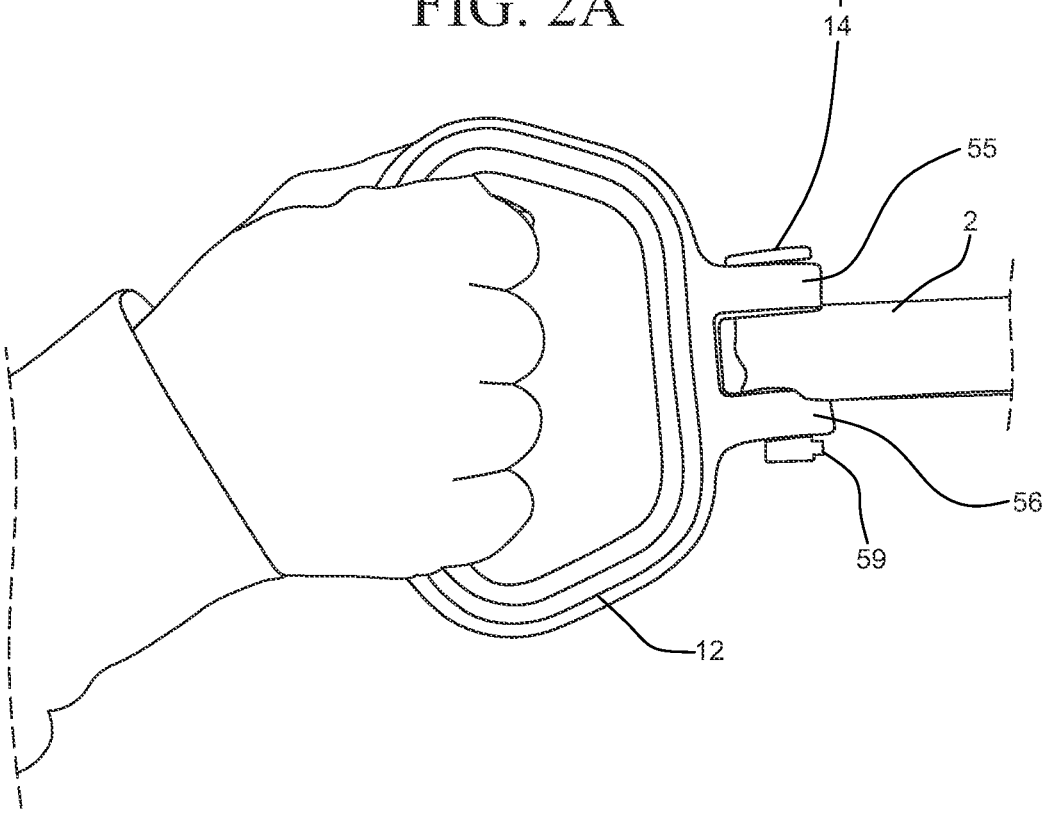
FIG. 2B.—is a diagram illustrating a top view of an exemplary panel lift apparatus handle at the first use stage opposite hand.

FIG. 2A and FIG. 2B shows 14, the shaft as a pin shape, which ends at 59 and passes 55 and 56. Whereas in FIG. 3, the 55 and 56 are similar lug, symmetrical, and mirror images of each other. These lugs 55 and 56 interconnect with the handle, which makes them one piece. Shaft 14 has ending part 59, which is the locking member of the handle. FIG. 2-7 are the different angles of the part of the apparatus called the handle, which is an integral part of the primary invention 30, whose description is as follows.

Figure 8:
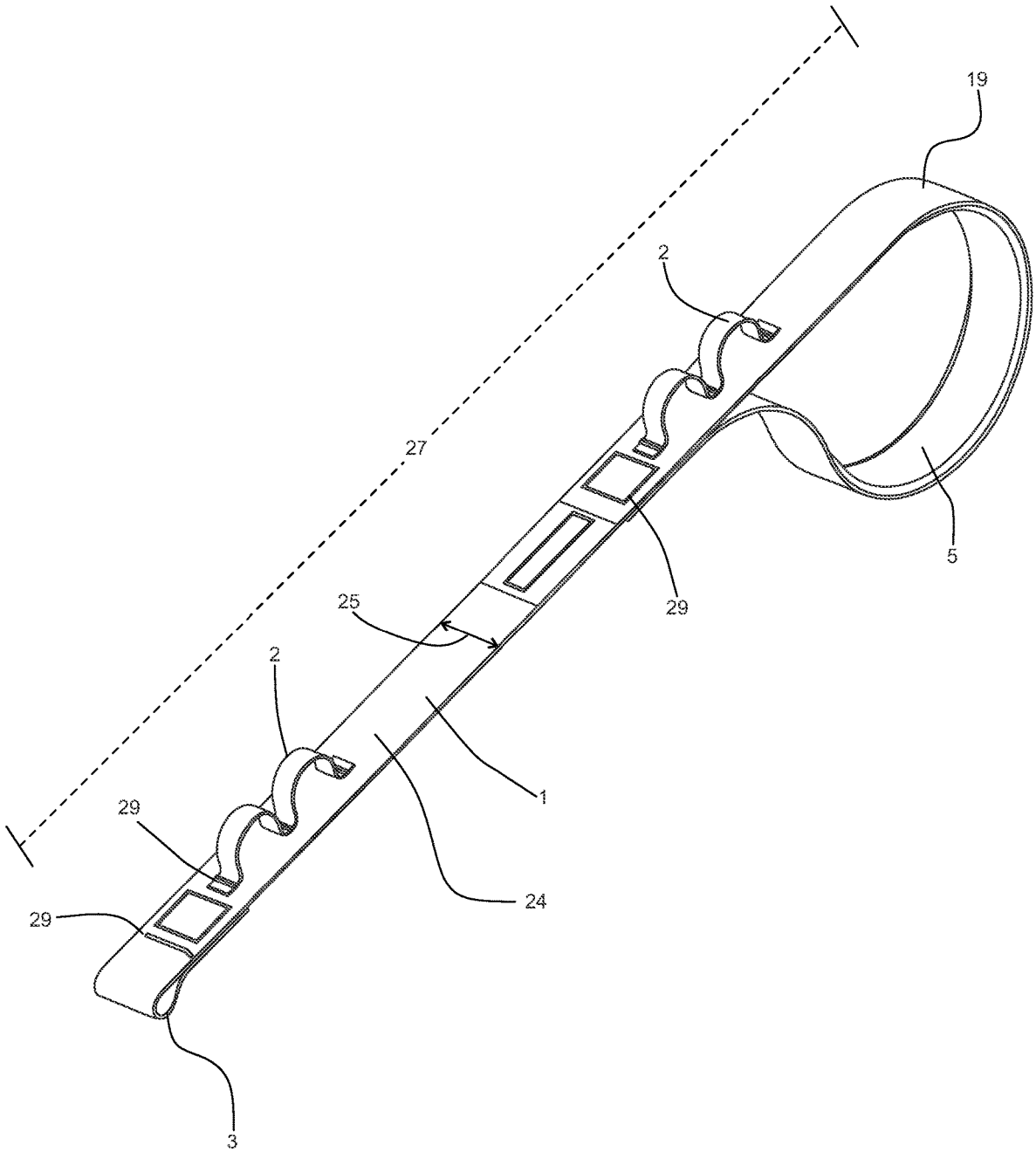
FIG. 8.—is a diagram illustrating a top view of a panel lift apparatus carabiner in accordance with an exemplary embodiment.
Figure 9:
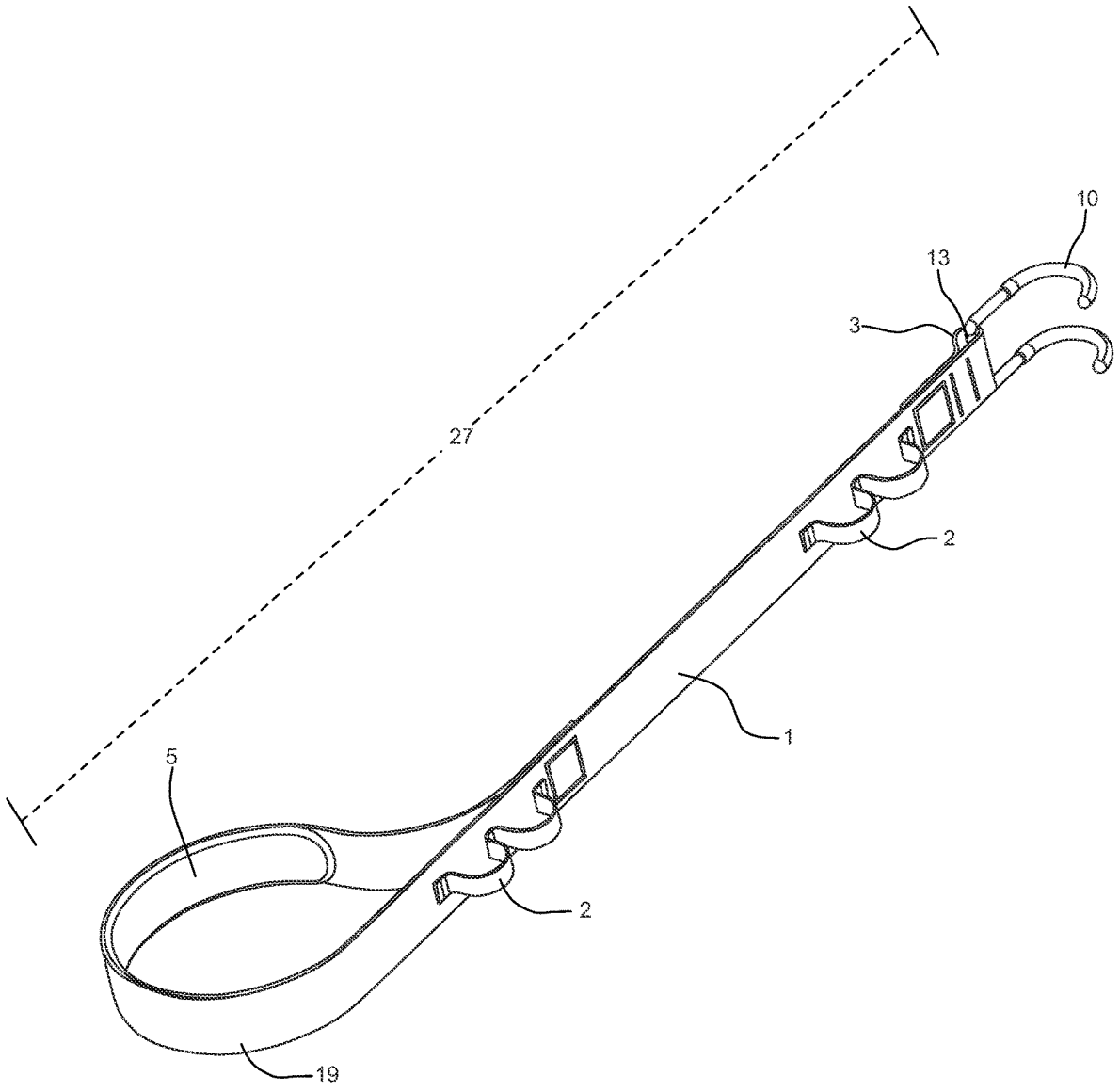
FIG. 9.—is a diagram illustrating a top and side angle view of a panel lift apparatus flexible webbing in accordance with an exemplary embodiment.
Figure 10:
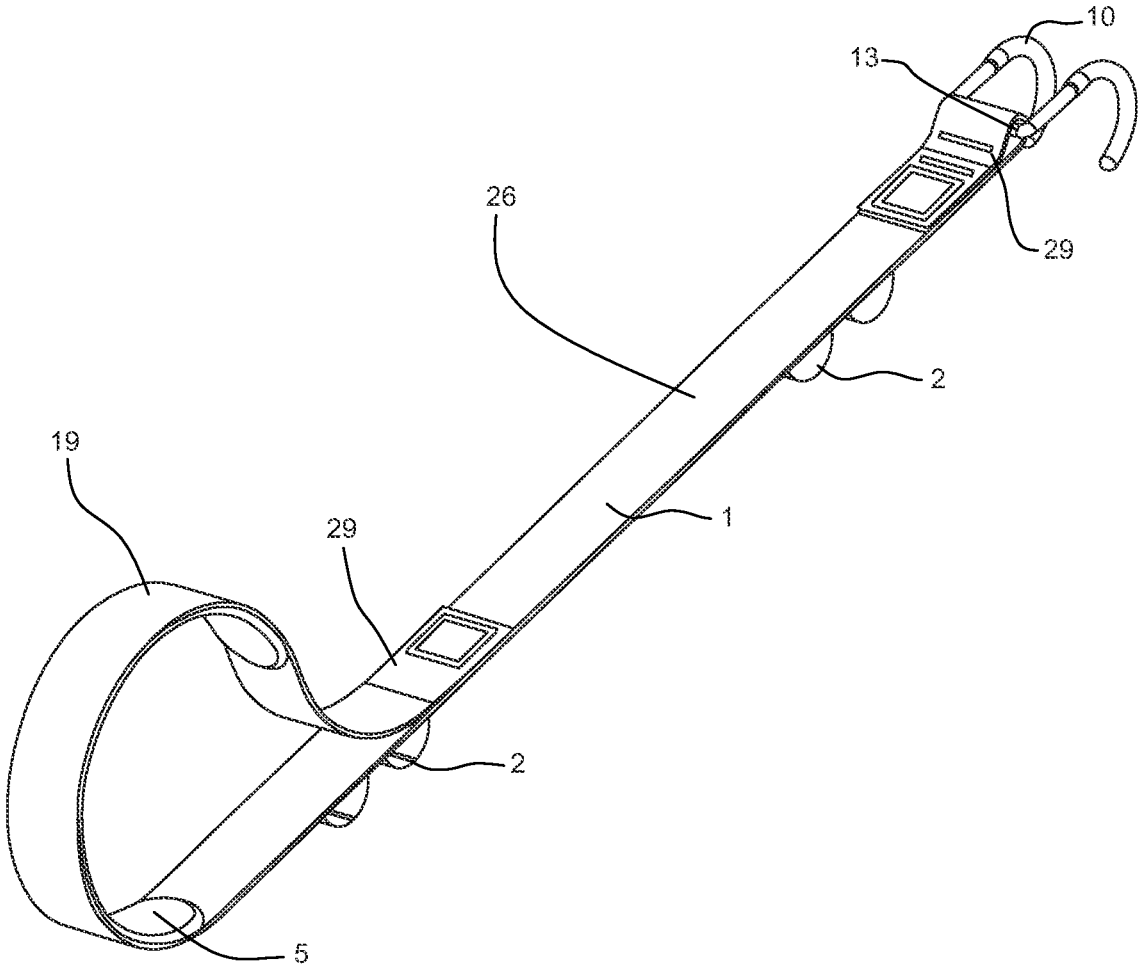
FIG. 10.—is a diagram illustrating a side view of a panel lift apparatus flexible webbing in accordance with an exemplary embodiment.

The flat flexible webbing 1 in FIG. 8 is the foundation for this invention. The flat flexible webbing 1 has a front side 24 shown in FIG. 8 with a primary surface that is a smooth and continuous surface, featuring an interwoven pattern of high-tensile strength fibers, which may include but is not limited to nylon, polyester, cotton, Dyneema or other synthetic materials. For this embodiment, polyester is the webbing fiber of choice due to its low cost and high-tensile strength. The pattern may include a variety of weaves, such as plain, twill, or satin weave, to provide specific load-bearing capabilities. FIG. 10 shows the flat flexible webbing backside 26, opposite the front side of the panel lift and carry apparatus. It is smooth and exhibits the same material as the front side, ensuring a balanced structure and uniform strength throughout the webbing. The width of the flat flexible webbing 25 in FIG. 9 refers to the distance between the two parallel edges running along its length. This width dimension 25 directly affects the load-carrying capacity of the webbing and can be adjusted to suit various applications. The width of 1.5 inches is the dimension for this embodiment. A safety orange polyester webbing is the color for this embodiment. The width of the flat flexible webbing may range from a few to several centimeters depending on the desired strength and flexibility. The length 27 in FIG. 9 of the flat flexible webbing describes the distance between its ends. The raw length of the flat flexible webbing for this embodiment is 35 inches. The length can be cut to custom lengths as required. The length may vary widely, catering to different applications and industries. The final manufactured product length is 24 inches for this embodiment. FIG. 9 best depicts a side view to show the thickness 28 of the flat flexible webbing, which refers to the distance between the front and back surfaces. It is carefully optimized to achieve the desired strength while maintaining flexibility and ease of handling. The thickness 28 for this embodiment is 1.5 mm. Both sides of the flat flexible webbing 28 include selvage edges, which run parallel to the length of the webbing to prevent fraying and ensure longevity. Additionally, these edges may feature reinforced stitching or other finishing techniques to enhance strength and prevent unraveling.

The flat flexible webbing 1 has fixed loops at each end, 3 and 19. The first and smaller fixed loop end 3 houses hook hardware 13, in accordance with an exemplary top view of the embodiment in FIG. 11 and a side view of the embodiment in FIG. 12, to securely attach handle(s) 12 or carabiner (s) 11 for conventional lifting, pulling, or carrying. The first fixed loop end 3 is smaller and securely houses the specialized hook hardware 10. This hardware 10 efficiently attaches to various items, enabling secure, safe lifting and carrying. The diameter fixed loop 3 for this embodiment is ⅝" to ¾" and has a sturdy construction to withstand the stresses of lifting objects. The smaller loop 3 securing by sewing high-strength industrial polyester triple bar stitching. The diameter of this first fixed loop end 3 allows for interchangeable hook hardware 10 of various sizes and shapes by simple twisting and pulling to remove hook hardware and replace it with the hook hardware of choice.

Figure 13:
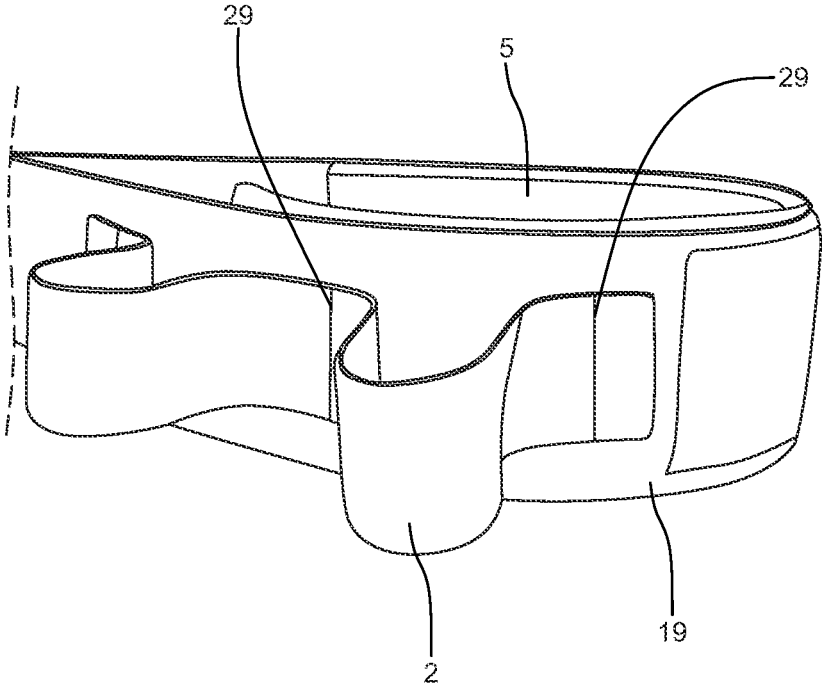
FIG. 13.—is a diagram illustrating a side view of a panel lift hook hardware in accordance with an exemplary embodiment.
Figure 14:
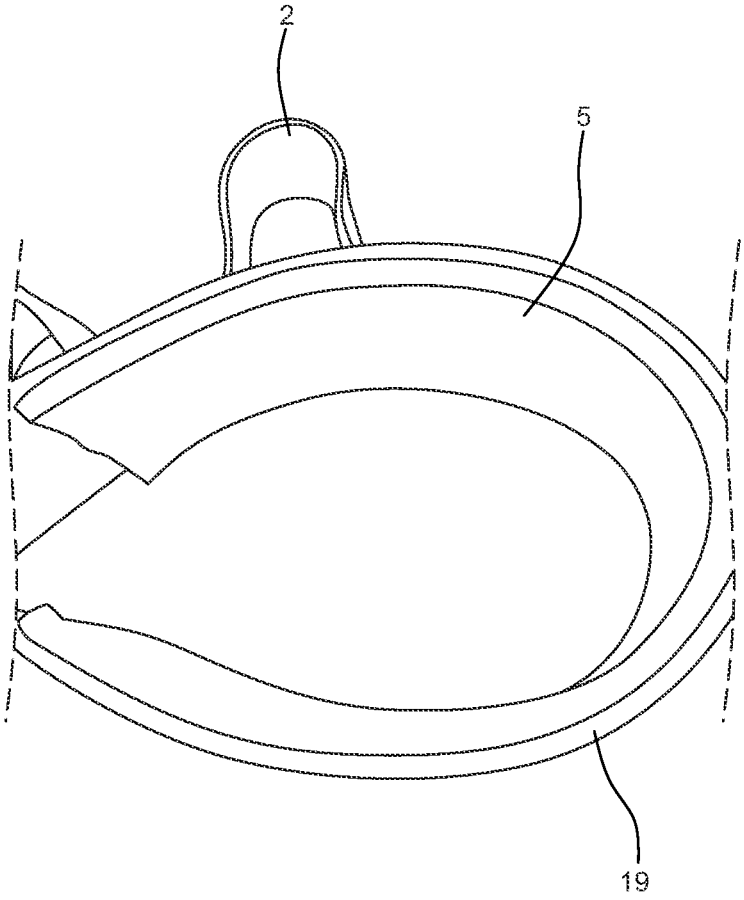
FIG. 14.—is a perspective top view of the padded wrist loop end, including the associated sewn daisy chain webbing loops mounted thereon.
Figure 15:
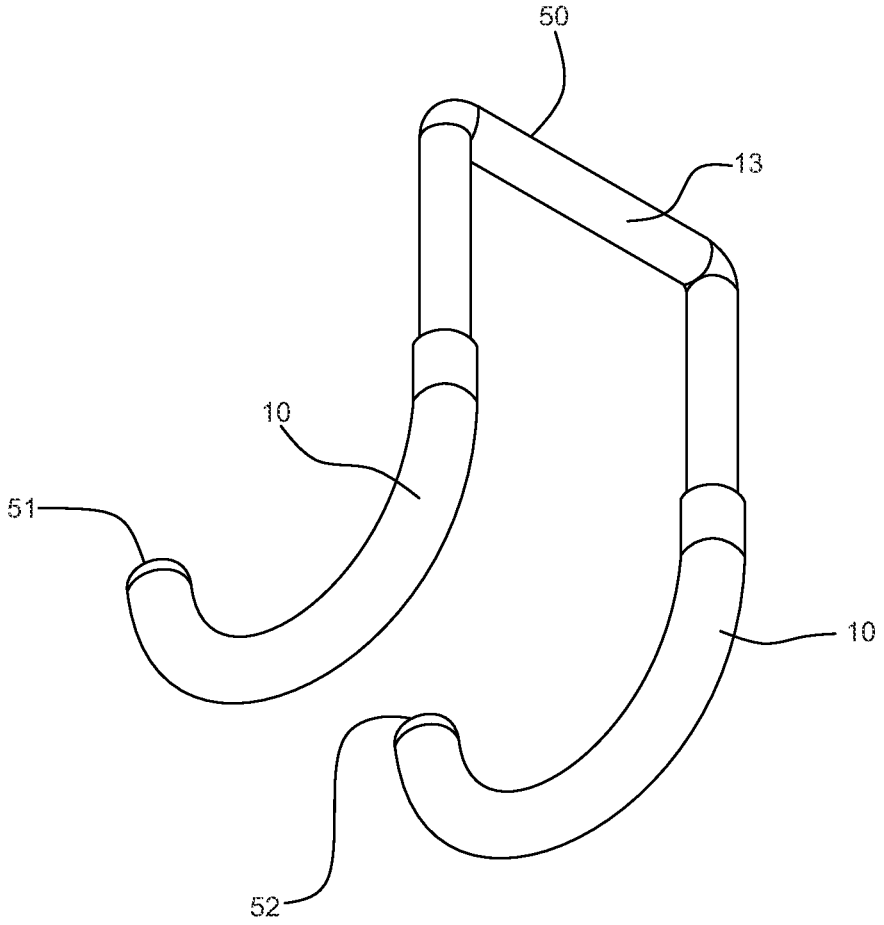
FIG. 15.—is a perspective side view of the panel lift apparatus padded wrist loop end, including the associated sewn daisy chain webbing loops mounted thereon.

The second fixed loop end 19, depicted in FIG. 13 as a top view and in FIG. 14 as a side view of the wrist loop. The wrist loop 19 is more extensive, padded 5, and provides a cushion wrist wrap alternative. The wrist loop provides a secure and snug hands-free lifting option to enhance user comfort and control during panel lifting. This arrangement reduces hand fatigue, enables easy storage, and ensures added safety by distributing the weight of an object to the wrist and enhancing control during lifting operations. The second fixed loop end 19 consists of a front side, backside, left, and right side. The second fixed loop end 19 is larger and padded 5 to facilitate wrist wrap attachment. It allows the user to secure the webbing comfortably around their wrist above the hand, freeing the hand for other tasks. The second fixed loop end 19 securing is by triple bar stitching using high-strength industrial polyester stitching. The padded cushion 5 of this embodiment is sewn onto the backside of the second fixed loop end 19, and the cushion dimensions are 2.5 mm in thickness, 1.5-inch width, and 8 inches in length. The second loop end 19 maintains a symmetrical design for balanced weight distribution. The larger padded loop 19 is a safety loop that can restrain the weight and regain control of an object if the handle slips from a user's hand. Flat flexible webbing engineering is to excel in various load-bearing scenarios. Its sturdy yet flexible construction allows employment in applications such as harnesses, slings, and numerous other fastening and securing systems. Its unique structure and design ensure optimal functionality, making it a valuable innovation with broad potential applications across different industries.

Figure 11:
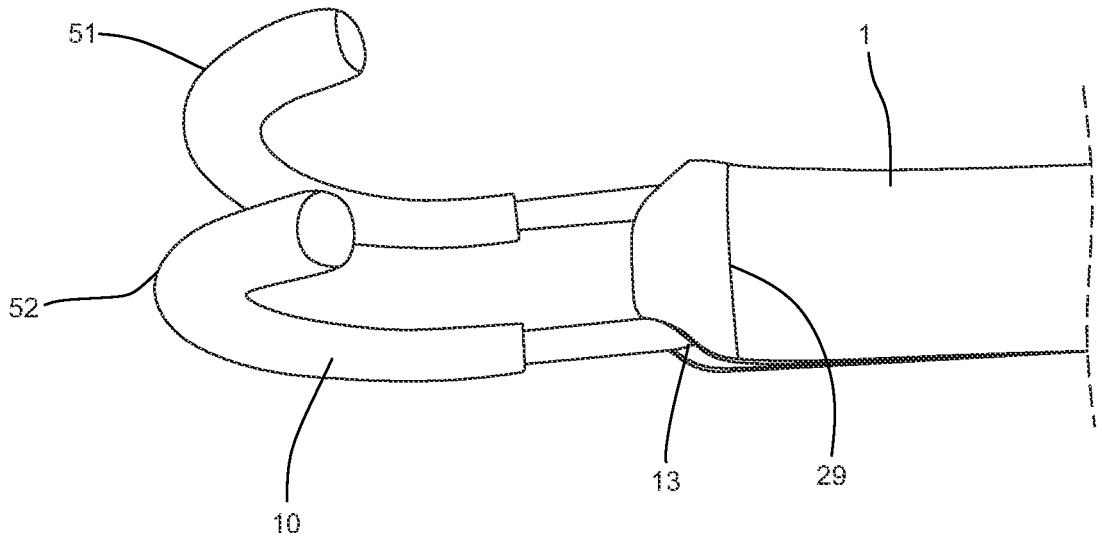
FIG. 11.—is a diagram illustrating a bottom view of a panel lift apparatus flexible webbing in accordance with an exemplary embodiment.
Figure 12:
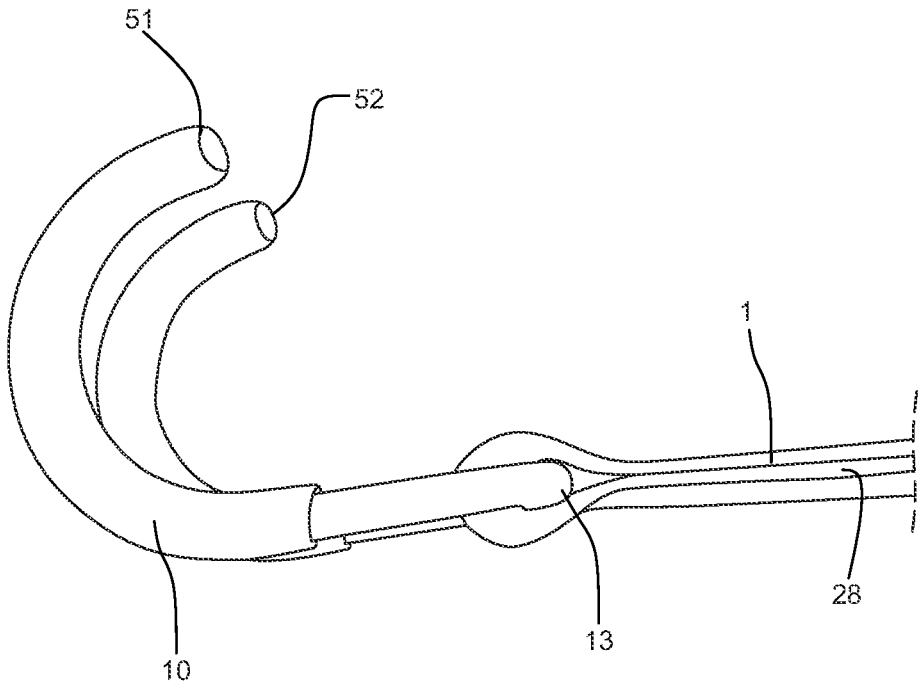
FIG. 12.—is a diagram illustrating a top view of a panel lift hook hardware in accordance with an exemplary embodiment.

FIG. 11 and FIG. 12—J-hook hardware 13 with a connecting base plate 50 is secured to the flat flexible webbing 1 at the first small fixed loop end 3 and shown in the illustration of this embodiment. The hook hardware 13 allows for a quick and secure attachment to compatible objects or anchor points, ensuring the panel remains securely in place during lifting and handling operations. Shown in FIG. 15 a rear and underneath view, FIG. 16 a front view, FIG. 17 a side view, and FIG. 18 a top view of the hook hardware in accordance with an exemplary embodiment. The base plate 50 provides stability, and even load distribution during lifting operations, and the design is to provide a reliable and sturdy connection to the flat flexible webbing. The hook hardware 13 has a base plate 50 that securely affixes to a left and right leg extending distally, then curves upward in a half U-shape to create a final J-hook configuration for this embodiment. The hook hardware's right leg 51 and left leg 52 has spacing between legs for improved balance and control of the lifted object. The two legs of the "J"-hook configurations are rubber coated 10 for this embodiment and form the main gripping, reduced slip, or grabbing mechanism for lifting items. The inside part 13 of the plastic-coated surface 10 of the right leg 51 and left leg 52 of the "J" hook hardware come in contact with the item. The rubber-coated surface 10 of the hook hardware legs 51 and 52 provide additional friction and reduce slippage during lifting and walking up or down inclines. Once lifted, the J-hook hardware 13 and flat flexible webbing 1 work together to distribute the load evenly, allowing the user to carry the item comfortably in a more upright and ergonomically safe position for improved production.

Figure 16:
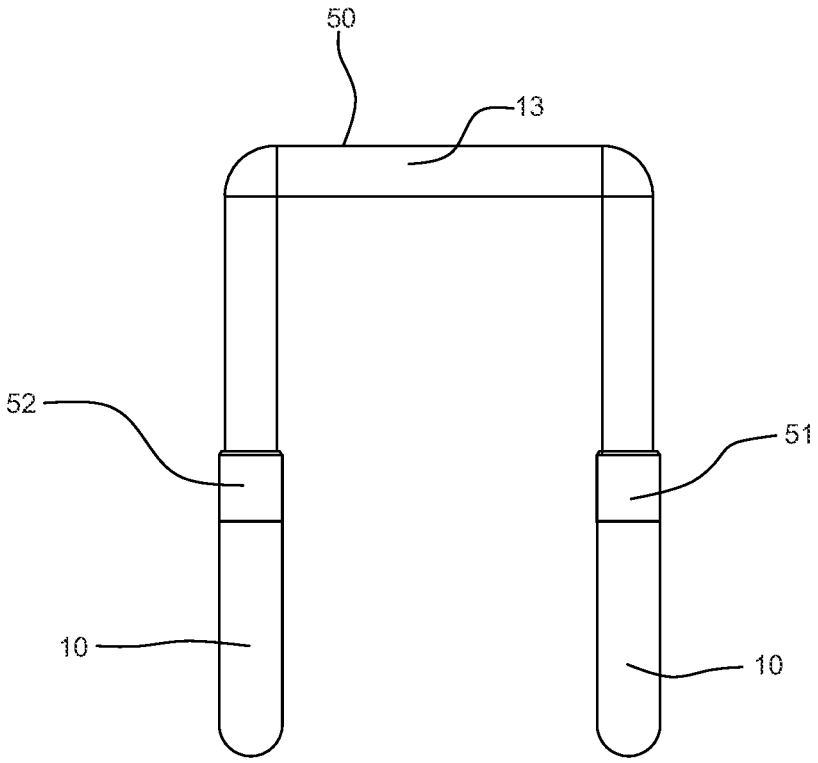
FIG. 16.—is a diagram illustrating a rear and underneath view of a panel lift apparatus hook hardware in accordance with an exemplary embodiment.
Figure 17:
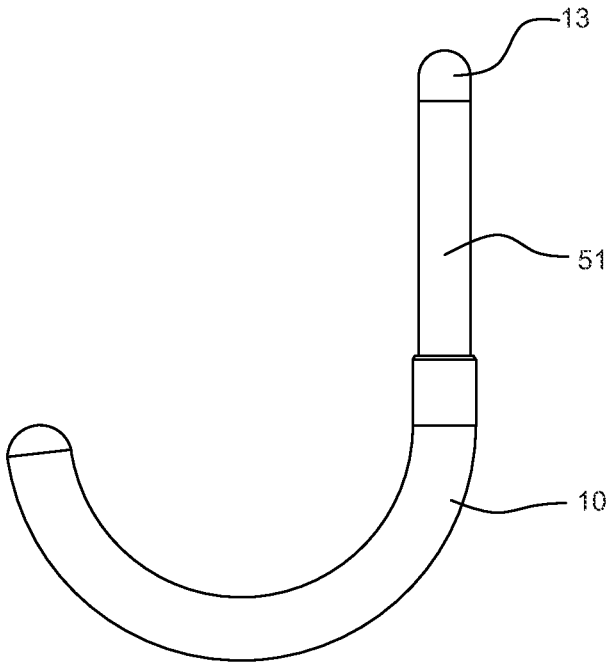
FIG. 17.—is a diagram illustrating a front view of a panel lift apparatus hook hardware in accordance with an exemplary embodiment.
Figure 18:
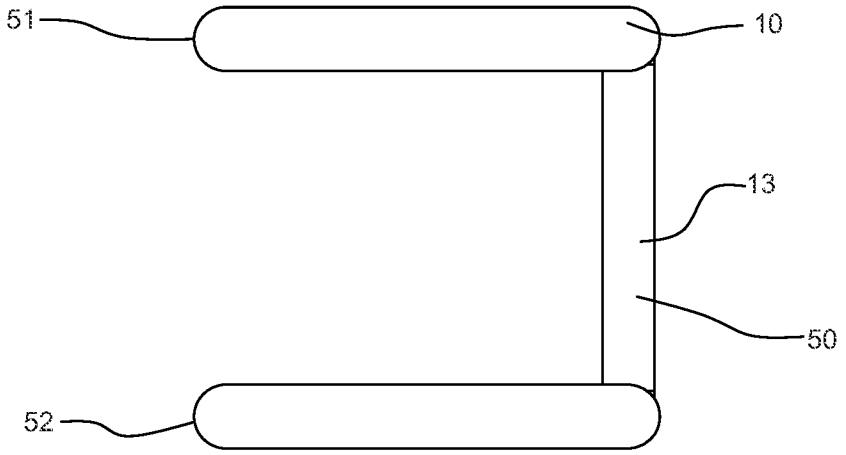
FIG. 18.—is a diagram illustrating a side view of hook hardware in accordance with an exemplary embodiment.

In FIG. 16, the distance between hook hardware legs 51 and 52 offers a design variation for improved balance and the wider distance between hook hardware legs 51 and 52. The hook hardware 13 mimics the functionality of a human hand to grab. The hook hardware 13 replaces the hand, thereby protecting the hand from stress, strain, and injuries while avoiding contact with hot, sharp, or rough surfaces. The hook hardware 13 composition is from high-load metal. The hook hardware is suitable for heavy lifting applications including but not limited to reinforced materials, steel, aluminum, titanium plastic, wood, fiber, glass reinforced materials, and carbon fiber.

Figure 19A:
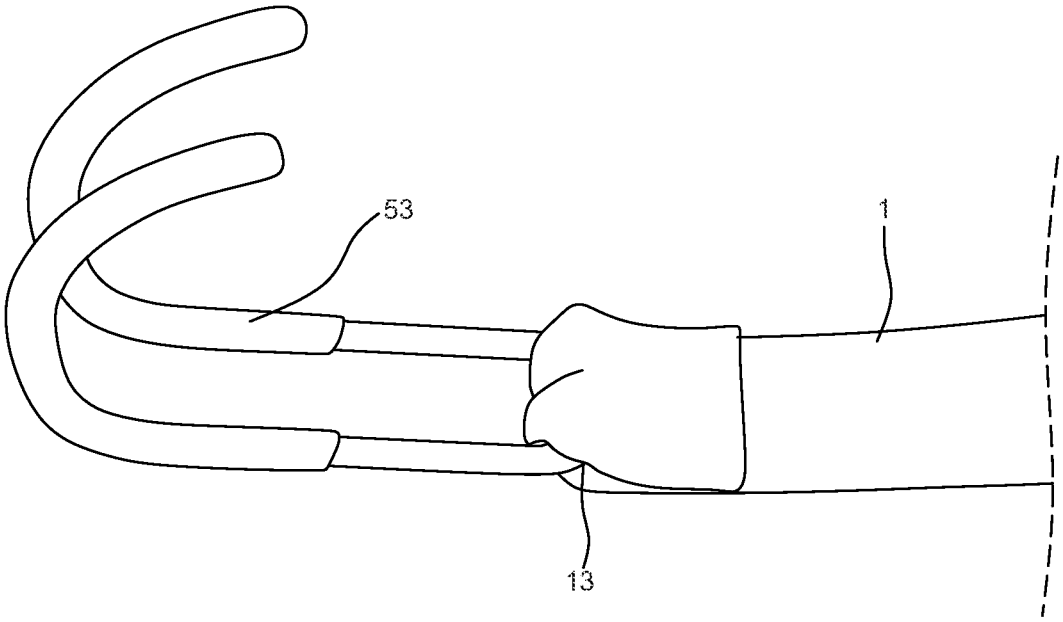
FIG. 19A.—is a diagram illustrating a top view of larger hook hardware in accordance with an exemplary embodiment.
Figure 19B:
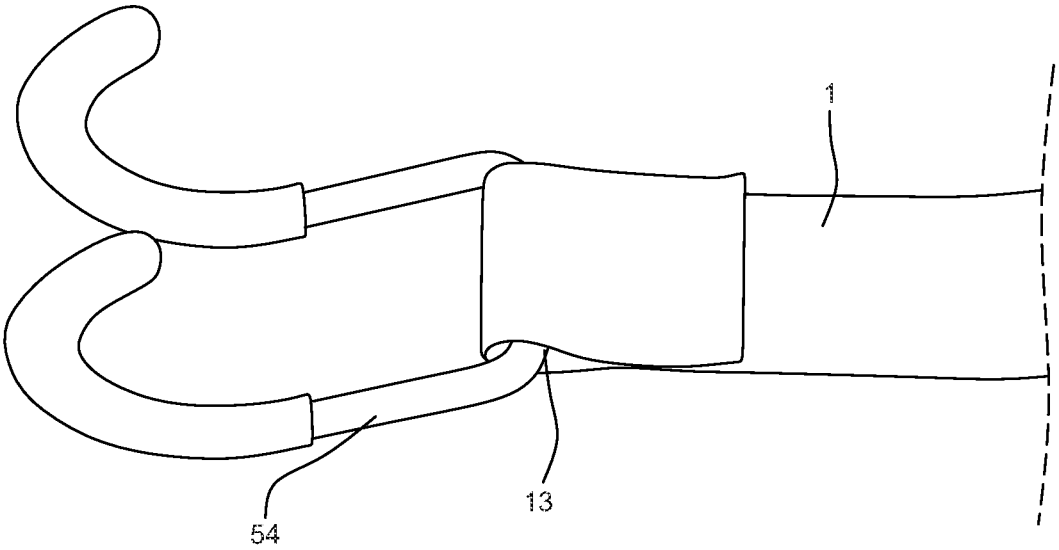
FIG. 19B.—is a diagram illustrating a top view of small hook hardware in accordance with an exemplary embodiment.

The design of the flat flexible webbing 1 at the first fixed loop 3 allows for easy interchangeability of hook hardware 13 types including but not limited to, various sizes, working load capacities, and shapes of hook hardware 13. These variations can also include but are not limited to, manufacturing the hook from materials such as plastic, metal (like steel or iron), carbon fiber, or aluminum. The hook hardware 13 is moved or placed into the small fixed opening 3 of the flat flexible webbing 1 with a small amount of pulling force and twisting the hook hardware 13. Shown in FIG. 19A is an image of more oversized hook hardware 53 that provides a greater surface area for gripping larger objects but manufacturing is from a smaller gauge metal diameter for a lighter load capacity. The smaller hook hardware 54 in FIG. 19B illustrates a more extensive gauge metal diameter post of hook hardware 13 designed to support a larger load capacity in accordance with the exemplary embodiment. This drawing in FIG. 19A and FIG. 19B represents only two variations of attachments available for the panel lift and carry apparatus. This feature enables users to adapt the lifting hook hardware based on the specific requirements of different lifting tasks.

Figure 3:
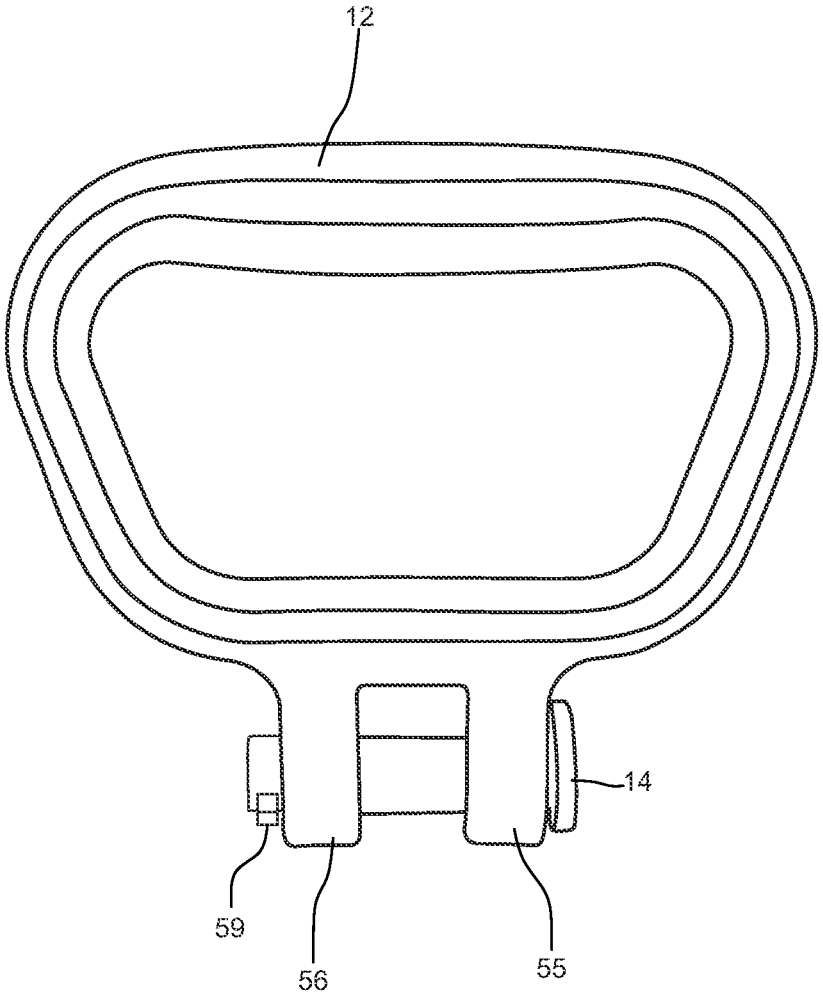
FIG. 3.—is a diagram illustrating a top view of a panel lift apparatus handle in accordance with an exemplary embodiment.
Figure 4:
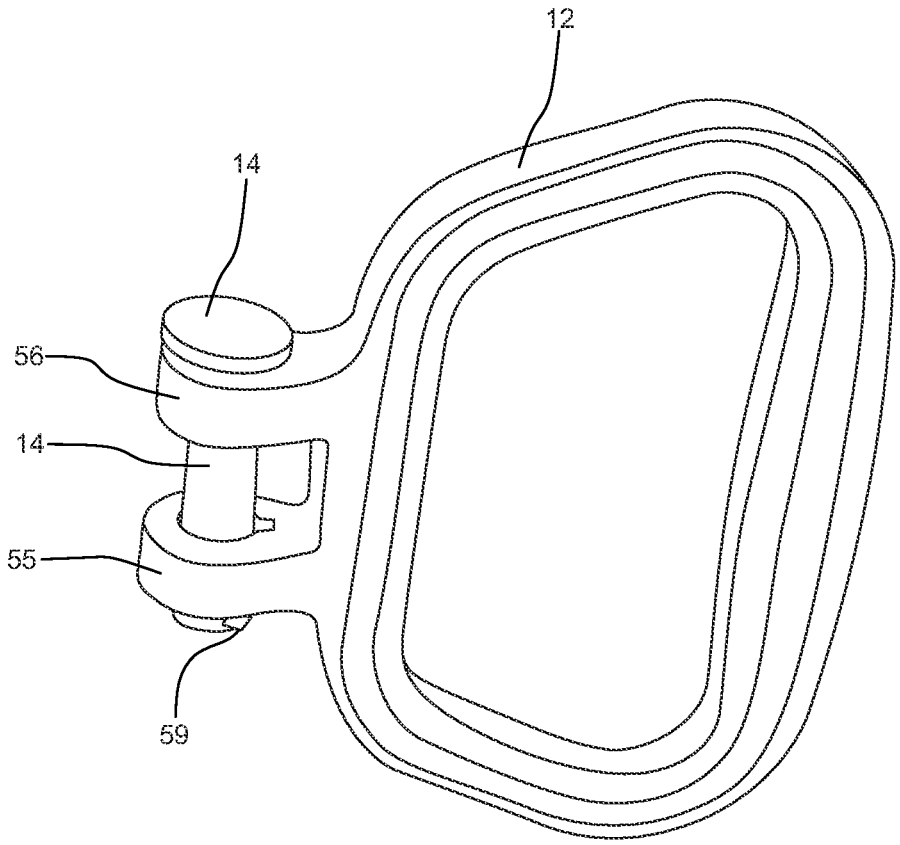
FIG. 4.—is a diagram illustrating a side angle view of a panel lift apparatus handle in accordance with an exemplary embodiment.

The closed-loop handle with locking removable peg 14 in FIG. 3 is a vital component and core element of the Universal Panel Lift and Carry Apparatus 30. FIG. 2 and FIG. 3 illustrate a top view of handle 12 of the exemplary apparatus. FIG. 3 is a side angle view of handle 12, representing an exemplary embodiment for a better understanding of the shape, structure, and ergonomics and its functionality with the panel lift and carry apparatus. In FIG. 2, handle 12 is shown in the first use stage. The diagram depicts a left hand and right hand gripping or grabbing the handle and focuses on showcasing the hand placement on the handle and will allow for left- or right-hand coordination for practical use. This closed-loop handle and locking removable peg 14 is specifically engineered for easy attachment to any daisy chain loops 2 of the flat flexible webbing 1, enabling the handle 12 to be used with the panel lift and carry apparatus. It features a continuous loop shape, forming a comfortable and ergonomic grip for users during lifting and carrying tasks. The closed-loop handle 12 incorporates a right peg leg 55 and a left peg leg 56 protruding from the handle loop's outer surface. These peg legs have a lug opening 57 or channels to accommodate the locking removable peg or pin 58. The locking removable peg or pin 14 is a shaft with a cylindrical shape and designed to pass through one peg leg lug opening 57, wherein accepting the webbing of the daisy chain loop 2 before peg 14 passing through the second peg leg lug opening 57 so its locking projection 59 will turn down and lock in place providing a sturdy connection to the flat flexible webbing 1.

Figure 5:
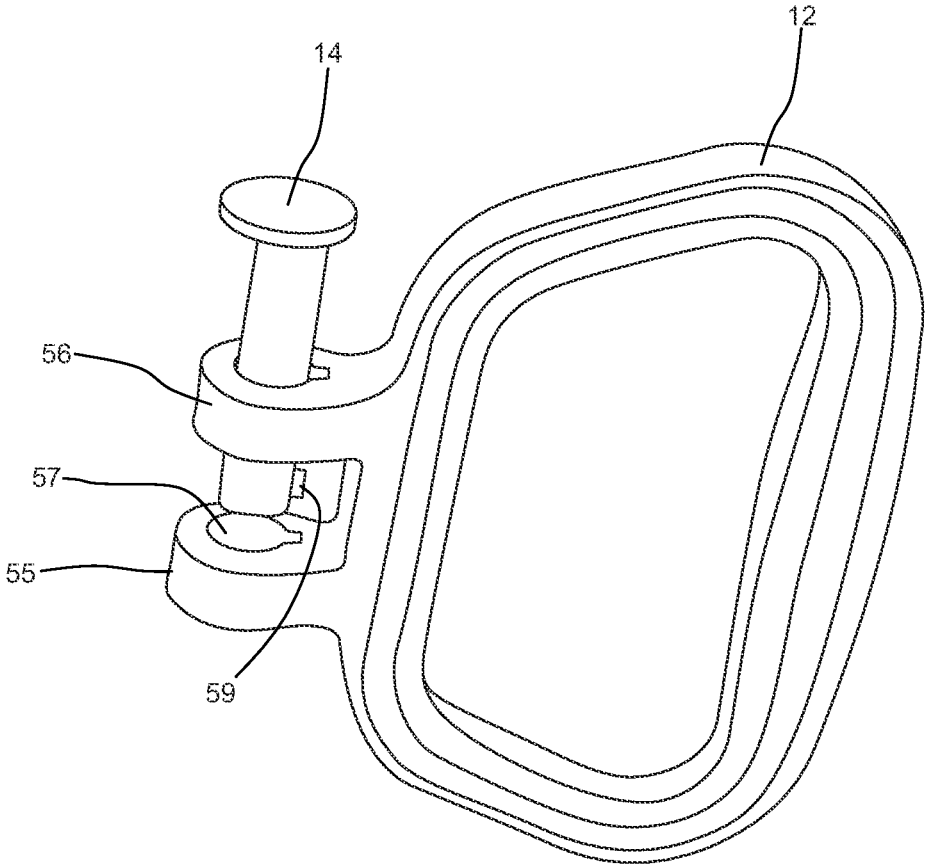
FIG. 5.—is a diagram illustrating a side angle view of an exemplary panel lift apparatus handle at the first stage of use, removing the peg from the handle.
Figure 6:
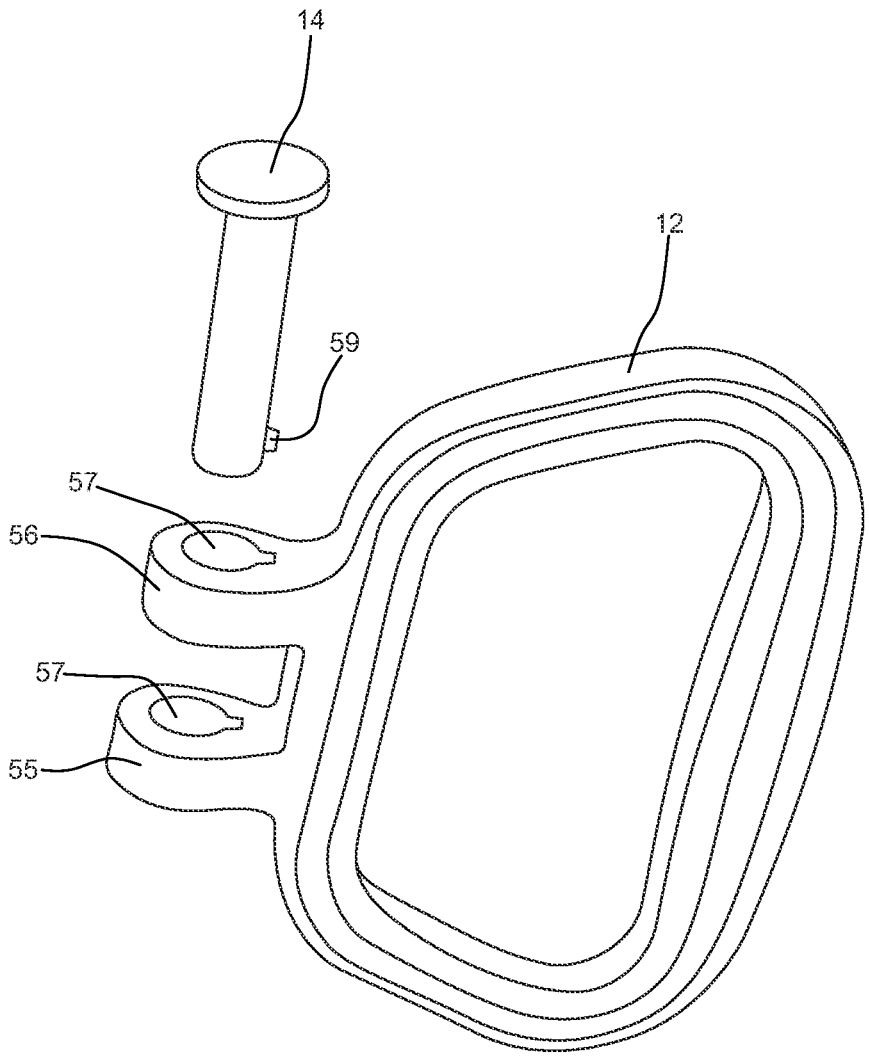
FIG. 6.—is a diagram illustrating a side angle view of an exemplary panel lift apparatus handle at the second stage of use, removing the peg from the handle.

FIG. 5 illustrates a side angle view of an exemplary panel lift apparatus handle 12 demonstrating the removal of the peg or pin 14 from the second peg leg lug opening 57 of the handle 12. Twisting peg 14 with the protruding tip 59 in the up or unlocked position allows the peg or pin 14 removals. This process highlights the simplicity and convenience of the handle 12 design when disengaging and separating peg 14 from the main structure of handle 12. FIG. 6, in this particular diagram, handle 12 is depicted with peg 14 removed to provide a clear understanding of the removal and replacement process of the peg or pin 14.

The closed-loop handle with locking removable peg 14 provides several advantages. The closed-loop handle 12 symmetrical design ensures a balanced load distribution on hand at any angle of pull by the user. By moving handle 12 to daisy chain loop 2 locations near the bottom, middle, or top of the flat flexible webbing 1, the user can adjust the length of pull when lifting items upward and outward. This feature offers flexibility and adaptability to various lifting scenarios.

The handle 12 can be attached to the daisy chain loop 2 directly or indirectly by methods including but not limited to clamps, pegs, carabiners, ropes, D-rings, O-rings, or hooks for a seamless attachment for optimal, more easy lifting and carrying. The design of the Universal Panel Lift and Carry Apparatus 30 allows for the replacement of the closed-loop handle with other handle types including, but not limited to, straps, padded webbing, tubing, rope, plastic, metal, or pipes that will ensure versatility, low cost, and customization based on users' specific lifting preferences and needs.

Figure 7:
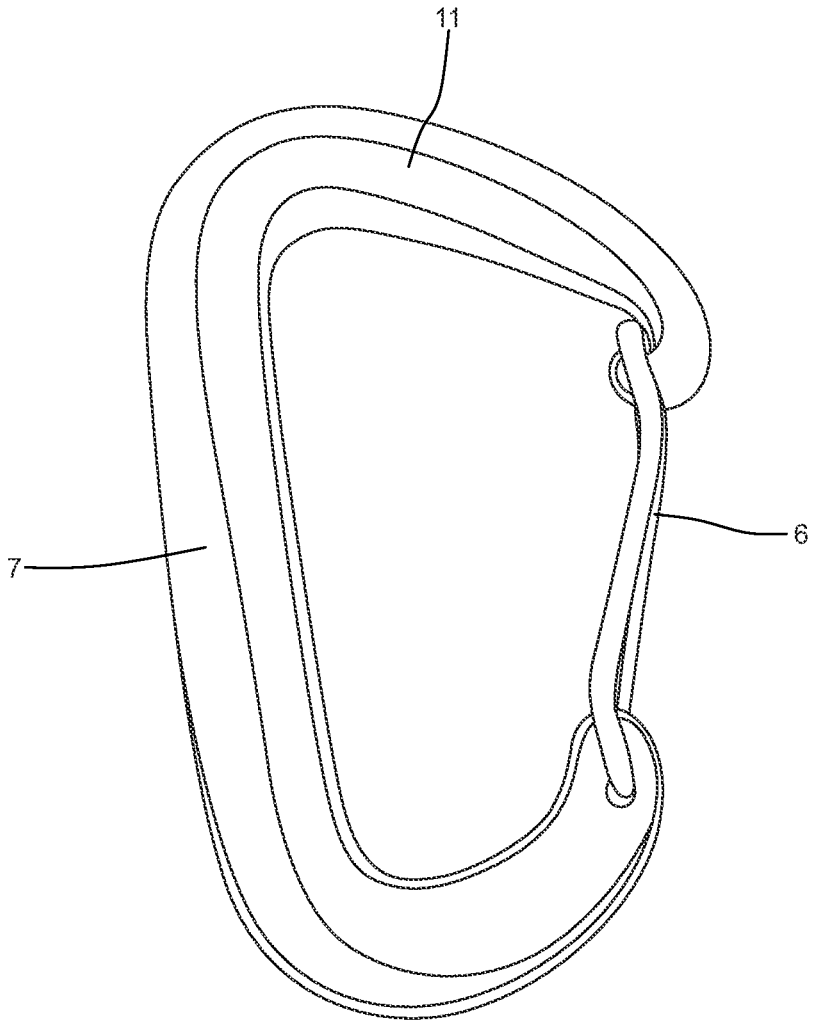
FIG. 7.—is a diagram illustrating a side angle view of a panel lift apparatus handle with a peg removed in accordance with an exemplary embodiment.

The spring-loaded carabiner 11, featuring a "D" shape, FIG. 7 represents a top view, showcasing its design. The carabiner 11 is a hardware component of the Universal Panel Lift and Carry Apparatus 30 used for connecting and securing various items for moving or used to store the apparatus. It is compact, durable, and lightweight, making it ideal for single-hand clipping and unclipping. The carabiner 11 features a front side 6 or central opening, which is spring-loaded for quick and effortless attachment. The opening is surrounded by a robust metal frame 7 for structural integrity and weight-bearing capacity. 12Kn airplane aluminum is the metal used for the carabiner of this embodiment. The back, left, and right sides of the carabiner 11 contribute to its overall stability and strength. The spring hook carabiner 11 is designed to attach a point along the daisy chain loops 2 of the flat flexible webbing 1, forming an essential component of the Universal Panel Lift and Carry Apparatus 30. The quick single-handle operation attachment and release features enable convenient adjustment of the apparatus's configuration and length, making it adaptable to various lifting and storage requirements. The spring hook carabiner 11 is engineered from high-strength materials to withstand heavy loads. It ensures that the Universal Panel Lift and Carry Apparatus 30 remain stable and secure during frequent use and potential impact or stress during lifting operations.

Figure 23:
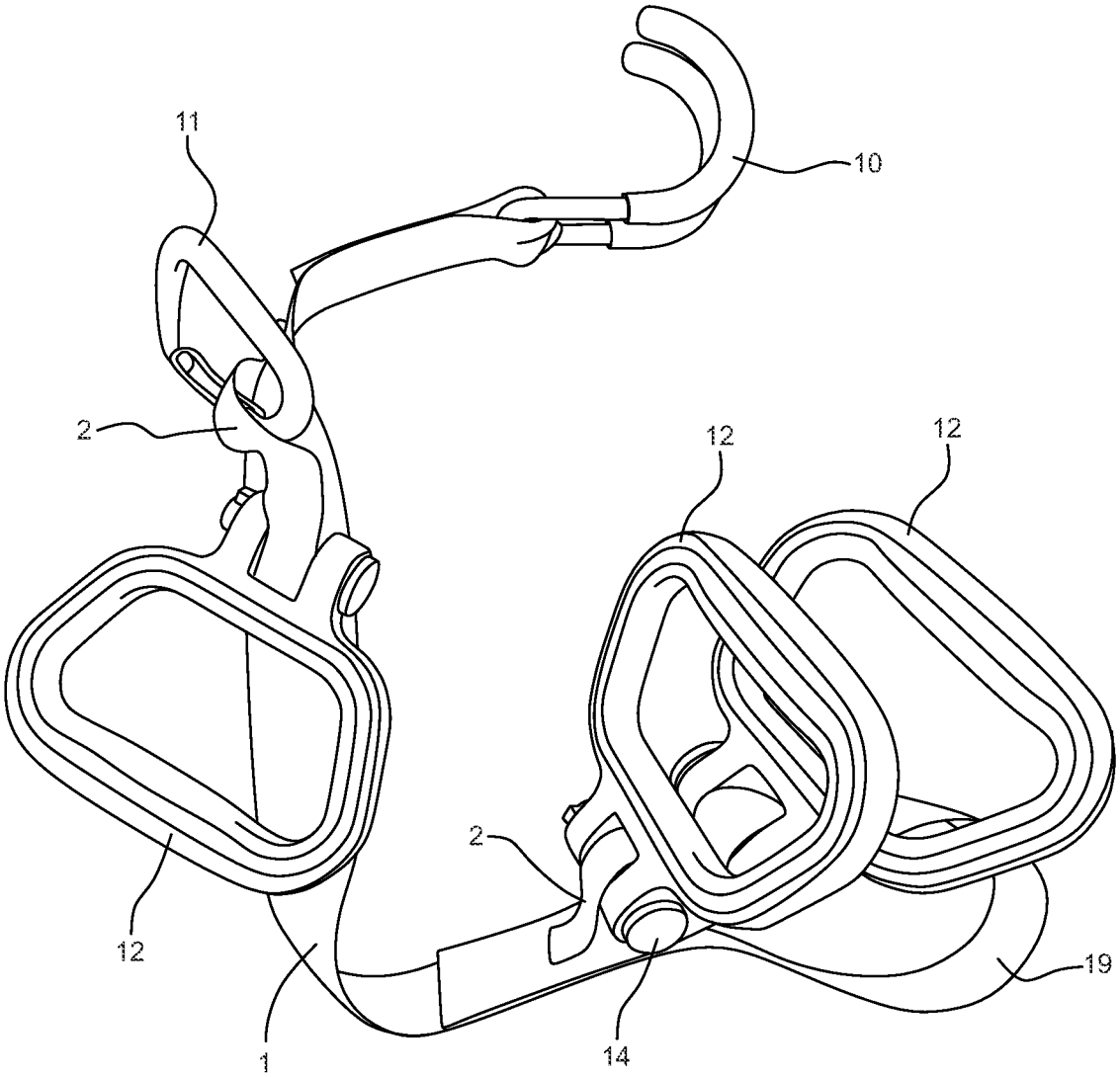
FIG. 23.—is a view illustrating a method of use of a panel lift apparatus system according to one particular exemplary embodiment.

To facilitate easy identification and positioning of handle 12 and carabiner 11 herein FIG. 8, the webbing incorporates a series of daisy chain loop segments 2. These pre-determined positions of daisy chain loop segments 2 help users to accurately adjust the webbing length and configurations for their specific applications. FIG. 23 shows a perspective view of a panel lift and carry apparatus with handle 12 and carabiner 11 positioned at multiple locations along the flat flexible webbing 1. The daisy chain loop segment 2 is created by folding and sewing portions of the flat flexible webbing to form dual loop segments. The daisy chain loops are a single layer of polyester webbing, 1-inch width and 1 mm thickness for this embodiment. A 1" diameter dual loop opening is created per segment using an 8" raw length polyester webbing, and triple bar stitching is sewn at each attachment point 29 of the daisy chain loop segment 2 to the flat flexible webbing 1. Longer and additional daisy chain loop segments 2 on the front side 24 or the back side 26 of the flat flexible webbing 1 add functionality to this embodiment. This embodiment shows drawings of two 1" diameter loops per daisy chain segment 2. The daisy chain segments 2 are spaced along the bottom, middle, and top of the flat flexible webbing for this embodiment, providing multiple attachment points for the handle(s) 12 and carabiner(s) 11 drawn in FIG. 8. Users may securely attach handles 12, grips, or straps to the daisy chain loop segments 2 including but not limited to D-rings, O-rings, pegs, hook hardware 13, ropes, straps or carabiners 11.

Figure 20:
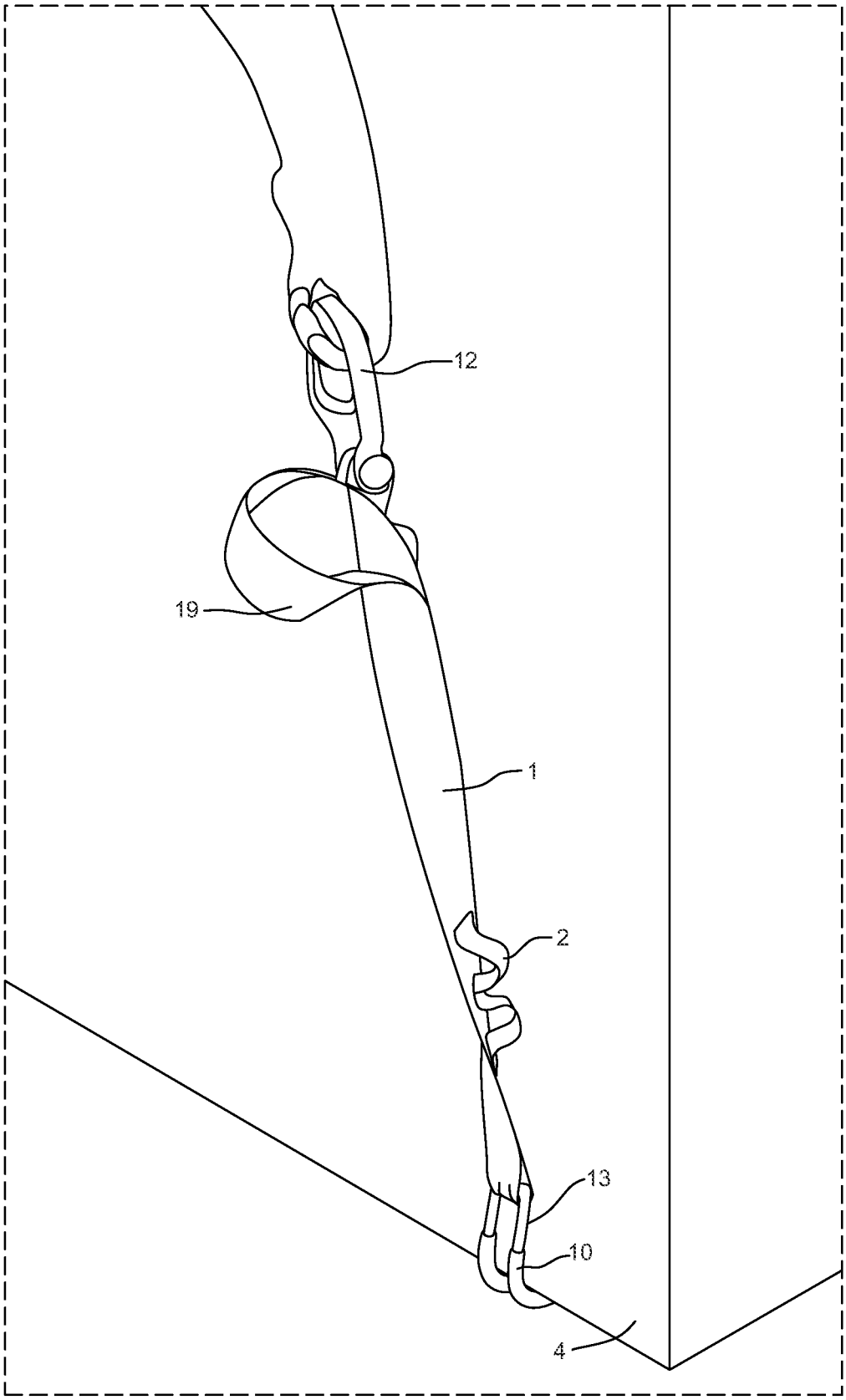
FIG. 20.—is a perspective top angle view of the panel lift attachment end, including the associated more oversized hook hardware and top and side angle view of smaller hook hardware mounted thereon.

FIG. 20 illustrates one of three methods of lifting and carrying using the apparatus according to one particular exemplary embodiment. In this method, the illustration depicts a hook hardware 13 connected to the bottom of a panel, and a person engages with the apparatus to lift and move the object. The person's arm extends, and they firmly grip the handle 12 of the panel lift and carry apparatus. By exerting an upward pull on the handle 12, the person may apply the necessary force to lift the item off the ground and initiate its movements. In this illustration, the padded wrist loop 19, which may be present in other embodiments, is not being used. Instead, the focus is on utilizing the handle and its positioning. The handle 12 is placed at the highest daisy chain loop segment 2 embodiment of the panel lift apparatus, allowing for adjustment of the height at which the person applies a pulling force. This flexibility enables the person to adapt to various lifting requirements.

Figure 21:
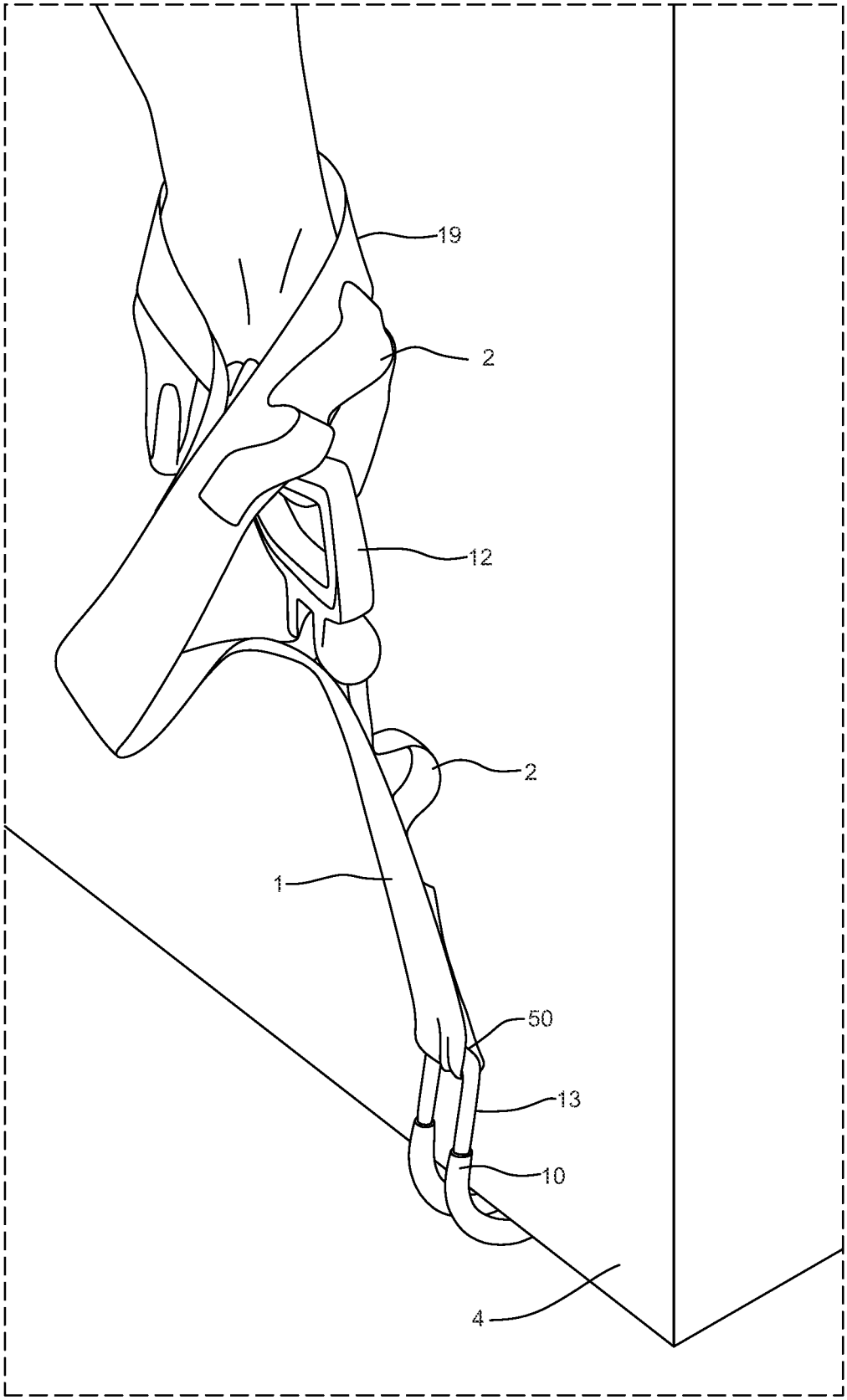
FIG. 21.—is a view illustrating a method of use of a panel lift apparatus system according to one particular exemplary embodiment.

FIG. 21.—is a view illustrating the second of three methods of lifting and carrying using the apparatus according to one particular exemplary embodiment. In the illustrated method, the person extends their arm and securely grips the handle 12. They provide an upward pull on handle 12 to lift the item off the ground. The upward force generated by the person's action lifts and moves the item. The padded wrist loop 19 serves two purposes. Firstly, it functions as a security strap that would transfer the weight of the item to the wrist in case the person's grip on the handle 12 slips, therefore reducing the risk of injury to the person and avoiding the breakage of the object. Secondly, the padded wrist loop 19 allows the person to continue working while the apparatus hangs out of the way on the wrist. The safety wrist loop eliminates the need to drop or store the apparatus when moving on to other tasks. In this embodiment, handle 12 in FIG. 21 is attached to the middle daisy loop segment of the panel lift and carry apparatus. The daisy loop segments 2 along the flat flexible webbing 1 provide several options for adjusting the height of the pull by the user.

Figure 22:
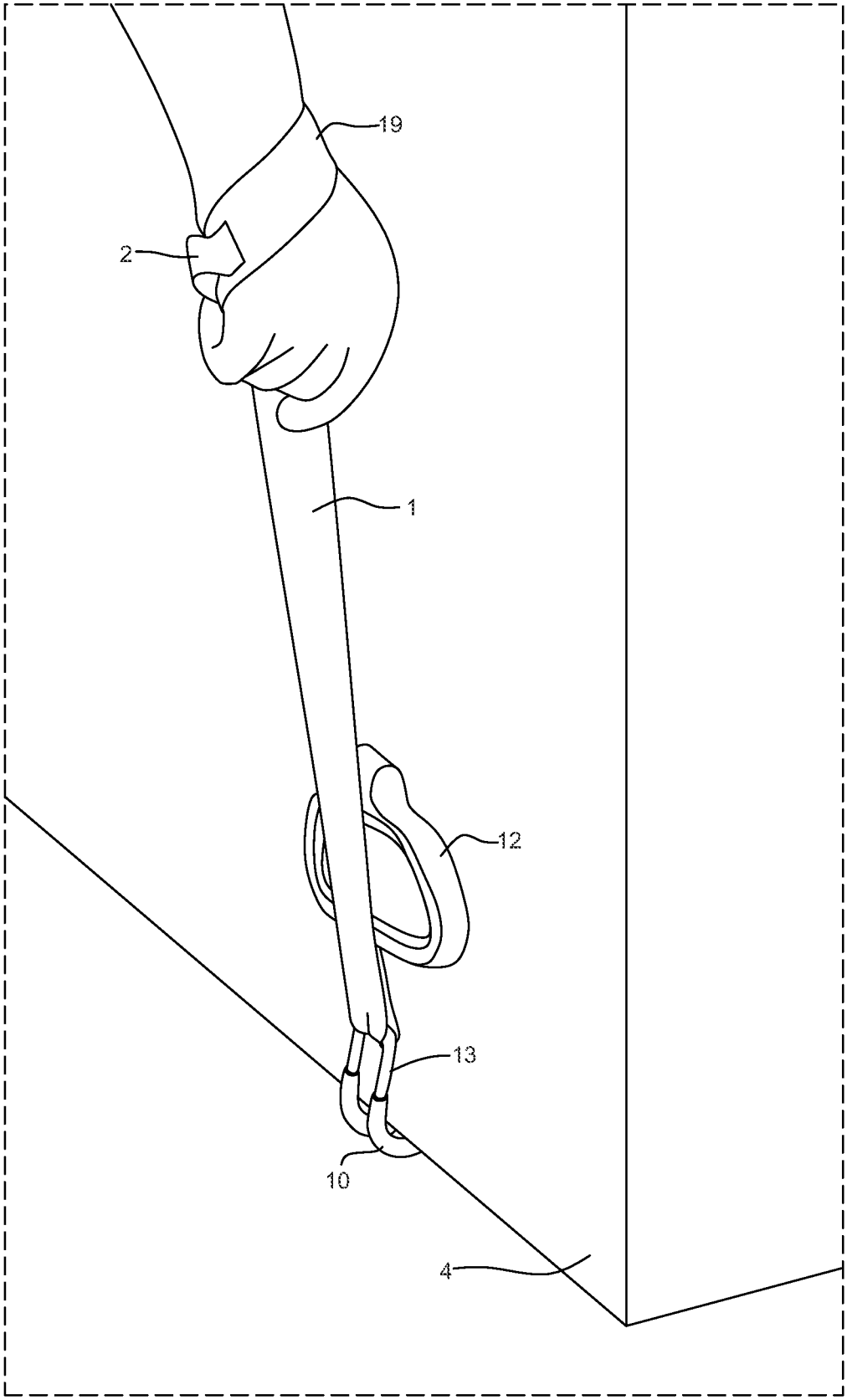
FIG. 22.—is a view illustrating a method of use of a panel lift apparatus system according to one particular exemplary embodiment.

FIG. 22.—is a view illustrating the third of three methods to lift and carry using the apparatus depicts only using the padded wrist loop 19 to move an item according to one particular exemplary embodiment. In this illustration, hook hardware 13 grabs the bottom of a panel. The person's arm extends with a secure grip by a padded wrist loop 19. The person provides an upward pull or force on the webbing to move the item off the ground. The upward force lifts and moves the item. In this illustration, the person only uses the padded wrist loop 19. The padded loop wrist served two purposes. One purpose of the padded wrist loop 19 is to secure the weight of an item to the wrist to reduce hand fatigue and may allow a user to lift heavier items. The second purpose of the padded wrist loop 19 is to continue working while the apparatus can hang out of the way while you move on to other tasks without having to drop the apparatus or store it away.

Figure 24:
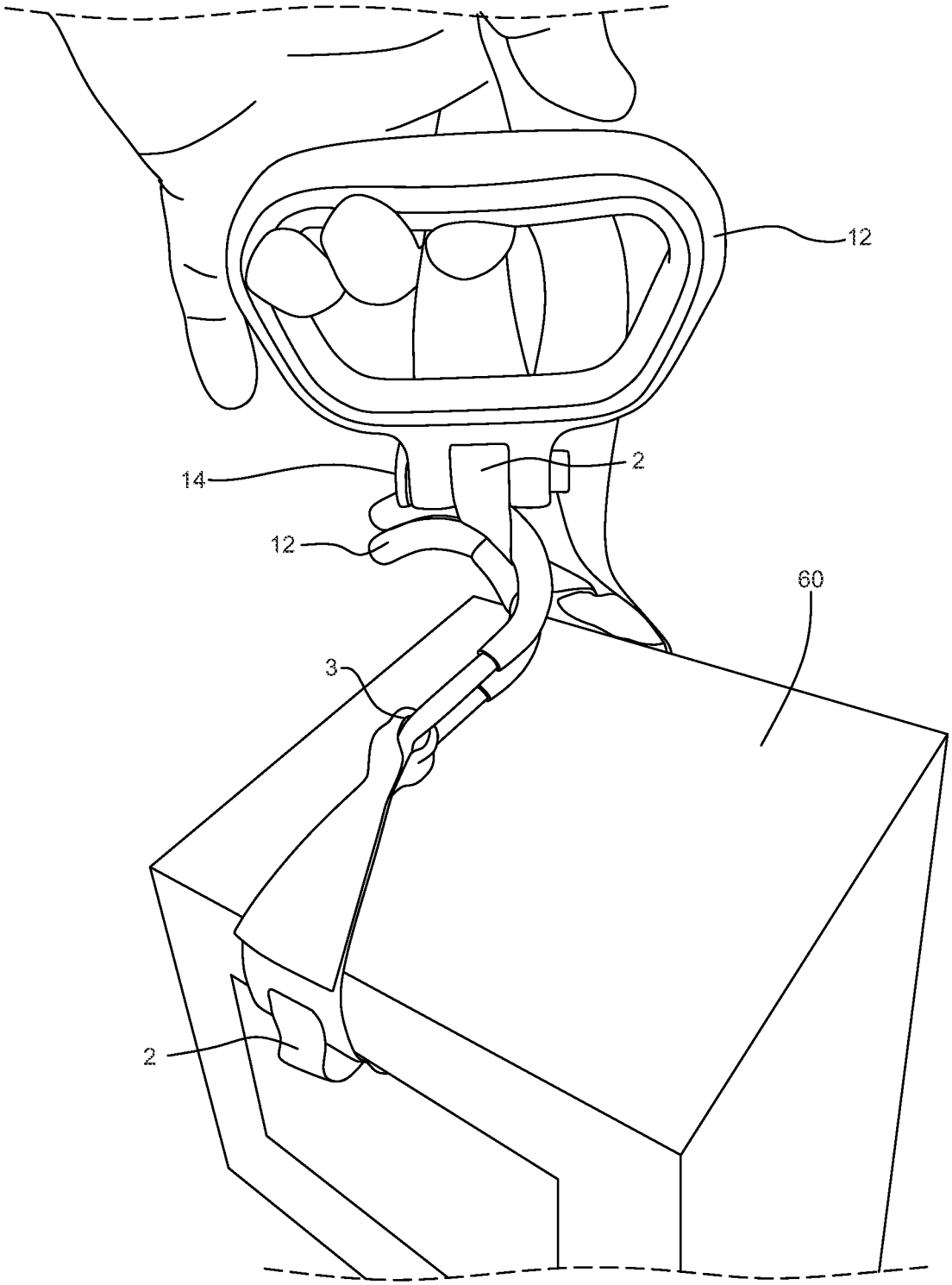
FIG. 24.—is a perspective view of the panel lift apparatus, including the associated multiple locations of handles and carabiner attachments to daisy chain webbing mounted thereon.

FIG. 24 depicts a method for utilizing a panel lift and carry apparatus based on a specific exemplary embodiment. This method may involve another approach for fastening a flexible webbing 1 to an object, which allows a person to lift, carry, pull, or store the object. The process comprises flexible webbing 1 is threaded through the opening of a cinder block 60, creating a loop. The cinder block serves as an anchor point for the webbing. A hook hardware 13 apparatus is also attached to a loop in a daisy chain 2. By securing the hook hardware 13 apparatus to the daisy chain loop 2, the cinder block 60 can be moved.

Figure 25:
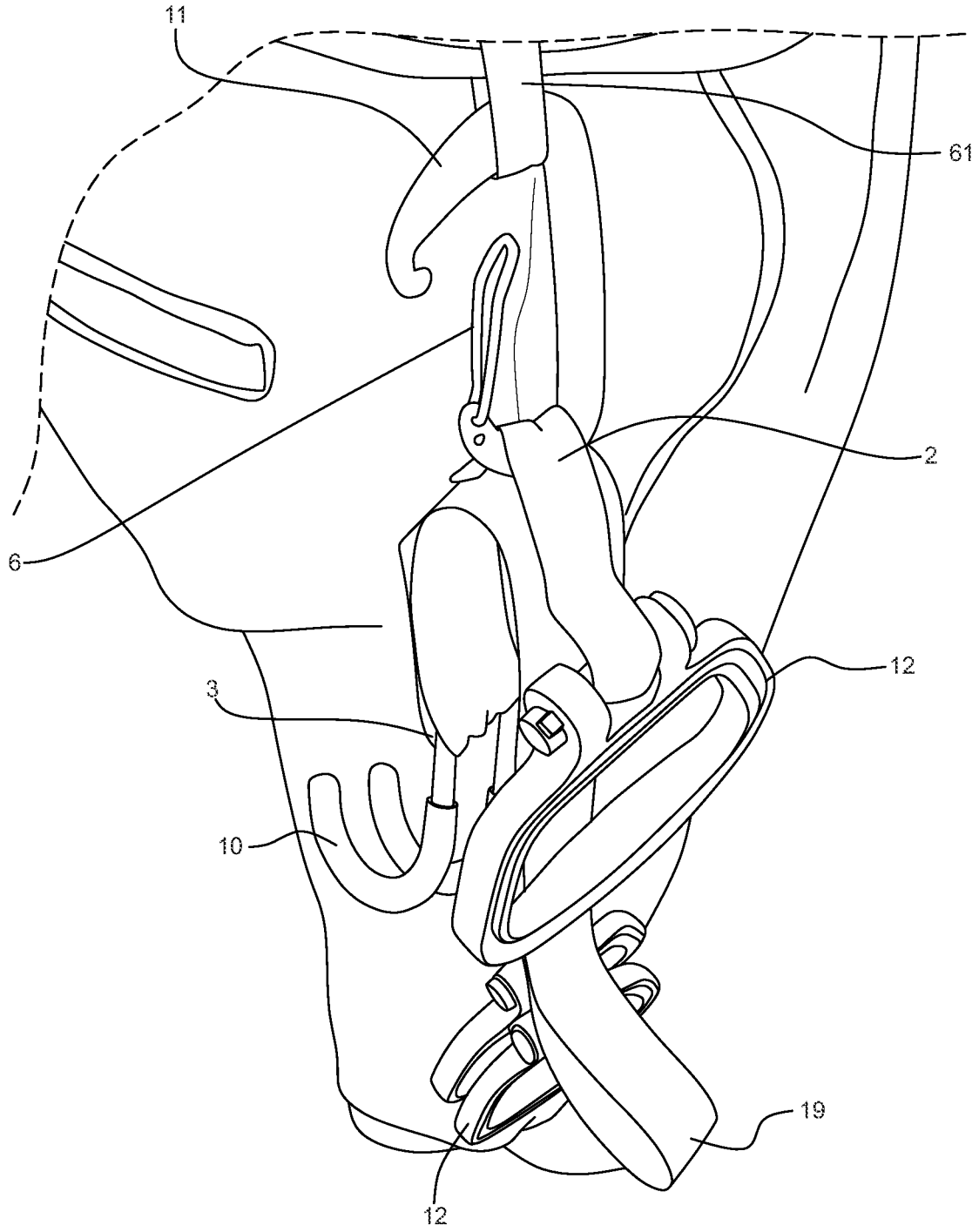
FIG. 25.—is a perspective view of the panel lift apparatus illustrating a method to secure and store the panel lift apparatus using a carabiner attached to the belt loop.

In this particular exemplary embodiment, FIG. 25. depicts a diagram illustrating a method for storing a panel lift and carry apparatus easily accessed when needed. The diagram shows a person having a belt loop 61 at their waist. The belt loop is typically a sturdy loop and easy attachment for a carabiner 11 to secure and store the panel lift and carry apparatus. The carabiner 11 is fastened to the panel lift apparatus on one end and hooked onto the belt loop 61 on the other end, ensuring a firm and reliable connection. This method allows for efficient storage and ensures the panel lift apparatus is readily available whenever required.

Overall, the diagram in FIG. 25. demonstrates a practical and convenient way to secure and store the panel lift apparatus using a carabiner 11 attached to the belt loop, providing easy accessibility and fast deployment when needed. Different features, variations, and multiple embodiments have been shown and described in various details. Descriptions in this application in terms of specific embodiments are for illustrative purposes only, without intending to limit or suggest that what has been conceived is only one particular embodiment or specific embodiments.

Achieve several benefits by employing the Universal Panel Lift and Carry Apparatus. The system reduces the amount of physical effort required and enhances the workers' efficiency. Moreover, it helps alleviate strain on the back and joints by enabling the person to move the object in an ergonomic, upright position. This positioning promotes better posture and improves pulling power and control during the lifting process.

This disclosure is not limited to any single specific embodiments or enumerated variations.

PARTS LIST

The following is a list of parts suitable for use in the present invention but are not limited to:

1—flat flexible webbing
2—daisy chain loop segment
3—small fixed loop opening of flat flexible webbing
4—panel
5—soft padding or cushion of the large fixed loop of the flat flexible webbing
6—front side of the carabiner with a spring-loaded gate
7—robust metal frame of the carabiner
10—rubber coating on the legs of the hook hardware
11—carabiner
12—handle
13—hook hardware
14—locking removable peg or pin
19—large fixed padded loop of the flat flexible webbing
24—front side of the flat flexible webbing
25—width of the flat flexible webbing
26—back side of the flat flexible webbing
27—length of the flat flexible webbing
28—thickness of the flat flexible webbing
29—an area of sewn triple-bar stitching
30—Panel Lift and Carry Apparatus
50—base plate or bar of the hook hardware
51—right leg of the hook hardware
52—left leg of the hook hardware
53—larger hook hardware
54—smaller hook hardware
55—right peg leg of the handle
56—left peg leg of the handle
57—Peg leg lug opening or channel
59—protruded tip or projection at the tip of the peg or pin
60—cinder block
61—belt loop

The invention claimed is:

1. A universal panel lift and carry apparatus comprising:

(a) a flat flexible webbing having a first fixed loop at a first end and a second fixed loop at a second end;

(b) a plurality of daisy-chain loop segments secured along a length of the webbing, each daisy-chain loop segment providing one or more attachment points;

(c) a hook hardware coupled to the first fixed loop, the hook hardware comprising a J-hook configuration having a reduced-slip surface configured to reduce slippage when engaging an object; and (d) a padded wrist loop formed at or integrated with the second fixed loop.

2. The universal panel lift and carry apparatus of claim 1, further comprising at least one non-fixed handle removably attachable to any of the daisy-chain loop segments.

3. The universal panel lift and carry apparatus of claim 2, wherein the handle includes at least one of padding, contouring, textured grip material, or ergonomic shaping.

4. The universal panel lift and carry apparatus of claim 2, wherein the handle is removably attachable to the daisy-chain loop segments directly or indirectly via a connector selected from the group consisting of clamps, pegs, carabiners, rings, and hooks.

5. The universal panel lift and carry apparatus of claim 2, wherein the handle is movable along the daisy-chain loop segments via a connector to adjust a pulling position or effective pull length of the webbing.

6. The universal panel lift and carry apparatus of claim 2, wherein repositioning the handle along the daisy-chain loop segments adjusts a pulling position to promote an ergonomic lifting posture.

7. The universal panel lift and carry apparatus of claim 1, further comprising at least one carabiner removably attachable to one or more of the daisy-chain loop segments.

8. The universal panel lift and carry apparatus of claim 7, wherein the apparatus is configured to be folded or suspended for storage using the carabiner, enabling compact storage and convenient transport when not in use, and the padded wrist loop allows the apparatus to remain secured to a user's wrist when not actively lifting an object.

9. The universal panel lift and carry apparatus of claim 7, wherein the at least one carabiner includes a spring-loaded carabiner configured for single-handed operation.

10. The universal panel lift and carry apparatus of claim 7, further comprising at least one non-fixed handle removably attachable to any of the daisy-chain loop segments, wherein repositioning the at least one carabiner or the at least one handle along the daisy-chain loop segments alters an effective lifting position of the webbing and wherein the padded wrist-receiving loop provides an alternative lifting option that transfers load to a user's wrist to permit hands-free lifting while the apparatus remains supported on the wrist.

11. The universal panel lift and carry apparatus of claim 1, wherein the flat flexible webbing comprises a material selected from the group consisting of polyester, nylon, polypropylene, cotton, and Dyneema.

12. The universal panel lift and carry apparatus of claim 1, wherein the daisy-chain loop segments are sewn at intervals along the webbing, and wherein a number, spacing, and length of the daisy-chain loop segments are selectable based on an intended application.

13. The universal panel lift and carry apparatus of claim 1, wherein the hook hardware comprises a plurality of legs.

14. The universal panel lift and carry apparatus of claim 13, wherein the reduced-slip surface comprises a rubber coating.

15. The universal panel lift and carry apparatus of claim 1, wherein selective attachment of a handle or carabiner to different daisy-chain loop segments modifies an effective pulling position or pull length of the webbing.

16. The universal panel lift and carry apparatus of claim 1, wherein the first fixed loop is configured to selectively receive interchangeable hook hardware having different sizes, shapes, or load capacities.

17. A method for lifting or carrying an object, comprising:
(a) providing the apparatus of claim 1;
(b) attaching a handle to a selected one of the daisy-chain loop segments; and
(c) lifting or carrying the object using either the handle or the padded wrist loop.

18. The universal panel lift and carry apparatus of claim 1, wherein the webbing has a length selected to accommodate lifting of panels and similar objects, and wherein the daisy-chain loop segments provide multiple reversible attachment points.

19. The universal panel lift and carry apparatus of claim 1, wherein the apparatus is configured for moving panels and similar awkward or heavy objects.

20. The universal panel lift and carry apparatus of claim 1, further comprising:
(e) at least one non-fixed handle removably attachable to one or more of the daisy-chain loop segments; and
(f) a carabiner removably attachable to one or more of the daisy-chain loop segments, wherein the handle and the carabiner are each selectively positionable along the daisy-chain loop segments to adjust an effective pulling position or pull length of the webbing and to enable storage of the apparatus when not in use.

21. A method of lifting or carrying an object, comprising:
(a) attaching the hook hardware of the apparatus of claim 1 to the object;
(b) gripping a handle removably attached to one of the daisy-chain loop segments or securing the padded wrist-receiving loop around a user's wrist; and
(c) lifting or carrying the object by applying force through the handle or through the wrist-receiving loop.

* * * * *